US006672296B2

(12) United States Patent
Ito et al.

(10) Patent No.: US 6,672,296 B2
(45) Date of Patent: Jan. 6, 2004

(54) CYLINDER HEAD STRUCTURE IN MULTI-CYLINDER ENGINE

(75) Inventors: Yasutoshi Ito, Wako (JP); Sadao Kojima, Wako (JP); Teruo Kobayashi, Wako (JP); Masakatsu Honda, Wako (JP); Shinji Yamada, Wako (JP); Masaki Kanehiro, Wako (JP); Naohiro Isogai, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/336,690

(22) Filed: Jan. 6, 2003

(65) Prior Publication Data

US 2003/0098005 A1 May 29, 2003

Related U.S. Application Data

(62) Division of application No. 09/314,962, filed on May 20, 1999, now Pat. No. 6,513,506.

(30) Foreign Application Priority Data

Dec. 1, 1998 (JP) ..... 10-341227
Dec. 1, 1998 (JP) ..... 10-341228

(51) Int. Cl.[7] ..... F02F 1/42
(52) U.S. Cl. ..... 123/672; 123/193.3
(58) Field of Search ..... 123/193.3, 193.5, 123/672–703; 60/276

(56) References Cited

U.S. PATENT DOCUMENTS

| | | | | |
|---|---|---|---|---|
| 4,037,408 A | | 7/1977 | Ozawa | 60/282 |
| 4,329,843 A | | 5/1982 | Inoue et al. | 60/274 |
| 4,637,368 A | | 1/1987 | Gillbrand et al. | 123/647 |
| 4,714,058 A | | 12/1987 | Oda et al. | 123/90.22 |
| 4,951,622 A | | 8/1990 | Takahashi et al. | 123/193 |
| 4,993,227 A | * | 2/1991 | Nagura et al. | 60/605.1 |
| 5,009,204 A | | 4/1991 | Ishii | 123/193 |
| 5,067,452 A | | 11/1991 | Eisbett et al. | 123/193.5 |
| 5,533,476 A | | 7/1996 | Anderson | 123/267 |
| 5,618,193 A | | 4/1997 | Nakajima et al. | 439/125 |
| 6,016,775 A | | 1/2000 | Kennedy | 123/193.5 |
| 6,082,103 A | * | 7/2000 | Sugiura et al. | 60/323 |
| 6,470,867 B2 | * | 10/2002 | Akiwa et al. | 123/672 |

FOREIGN PATENT DOCUMENTS

| | | |
|---|---|---|
| EP | 0 279 124 | 8/1988 |
| EP | 0 591 737 A1 | 4/1994 |
| EP | 0 654 589 A2 | 5/1995 |
| FR | 2721349 | 12/1995 |
| JP | 7-34198 | 8/1995 |
| JP | 2709815 | 10/1997 |
| JP | 10115251 A | 5/1998 |

* cited by examiner

*Primary Examiner*—Henry C. Yuen
*Assistant Examiner*—Arnold Castro
(74) *Attorney, Agent, or Firm*—Arent Fox Kintner Plotkin & Kahn, PLLC

(57) ABSTRACT

A collecting exhaust port 18 provided in a cylinder head 12 is comprised of exhaust port sections 46 extending from exhaust valve bores 35 in cylinders 14, and an exhaust collecting section 47 in which the exhaust port sections 46 are collected. The cylinder head 12 includes a protrusion 49 projecting in an arch shape outside a side wall $\mathbf{11}_1$ of a cylinder block 11. The exhaust collecting section 47 of the collecting exhaust port 18 directly faces an inner surface of a side wall $^{12}$ of the protrusion 49. Water jackets $J_2$ and $J_3$ for cooling the protrusion 49 are provided in upper and lower surfaces of the protrusion 49 having the collecting exhaust port 18 defined therein. The water jackets $J_2$ and $J_3$ are not provided between the side wall $\mathbf{12}_1$ of the protrusion 49 and the exhaust collecting section 47. Thus, the compact cylinder head 12 having the collecting exhaust port 18 integrally provided therein can be formed, while avoiding the complication of the structure of a core.

10 Claims, 23 Drawing Sheets

CYLINDER HEAD STRUCTURE IN MULTI-CYLINDER ENGINE

This is a Division of application Ser. No. 09/314,962, filed May 20, 1999 which issued as U.S. Pat. No. 6,513,506 B1 on Feb. 4, 2003.

BACKGROUND OF THE INVENTION

1. Field of the Invention

The present invention relates to a cylinder head structure in a multi-cylinder engine, including a collecting exhaust port which is comprised of exhaust port sections extending from a plurality of combustion chambers arranged along a cylinder array, respectively, the port sections being integrally collected together in an exhaust collecting section defined within a cylinder head.

2. Description of the Related Art

In general, an exhaust port defined in a cylinder head in a multi-cylinder engine serves only to collect exhaust gases discharged from a plurality of exhaust valve bores in the same cylinder in the cylinder head, and the collection of the exhaust gases discharged from the cylinders is carried out in a separate exhaust manifold coupled to the cylinder head.

On the contrary, there is a cylinder head structure which is known from Japanese Patent No. 2709815, in which the collection of the exhaust gases discharged from the cylinders is carried out in the cylinder head without using a separate exhaust manifold. In such cylinder head structure, the entire periphery of collecting exhaust ports integrally collected together within the cylinder head is surrounded by a water jacket to enhance the cooling efficiency, so that the durability can be ensured, even if the cylinder head is made using a material poor in heat resistance.

However, the cylinder head structure described in Japanese Patent No. 2709815 suffers from a problem that the cylinder head is large-sized because the entire side surface of the cylinder head provided with an exhaust collecting section projects in a large amount sideways from a mating surface of the cylinder head with a cylinder block. Further, the structure suffers from a problem that the cylinder head is large-sized to hinder the compactness of the entire engine and increase the vibration, because the entire periphery of the collecting exhaust ports integrally collected together within the cylinder head is surrounded by the water jacket. Moreover, a collecting exhaust port forming core and a water jacket forming core each having a complicated shape cannot be assembled intact. It is required that either one of the cores or both the cores be divided into parts and assembled. For this reason, there is a possibility that the structures of the cores may further be complicated, not only causing an increase in cost, but also causing a reduction in accuracy of the completed cylinder head.

SUMMARY OF THE INVENTION

Accordingly, it is an object of the present invention to ensure that the cylinder head including the collecting exhaust port integrally provided therein can be made as compact as possible, and the exhaust collecting section can be formed by molding, while avoiding the complication of the core structure.

To achieve the above object, according to a first aspect and feature of the present invention, there is provided a cylinder head structure in a multi-cylinder engine, comprising a collecting exhaust port which is comprised of exhaust port sections extending from a plurality of combustion chambers arranged along a cylinder array, respectively, and integrally collected together in an exhaust collecting section defined within a cylinder head, wherein the structure includes a protrusion provided on a side surface of the cylinder head to project outside a side surface of a cylinder block to which the cylinder head is coupled, the protrusion projecting outwards in a largest amount in the exhaust collecting section.

With the above arrangement, the protrusion projecting outwards from the side surface of the cylinder head projects outwards in the largest amount in the exhaust collecting section. Therefore, the size of the protrusion can be reduced to contribute to the compactness of the cylinder head, as compared with a structure including a water jacket provided outside the exhaust collecting section. Moreover, the weight of the protrusion is decreased and hence, the vibration of the cylinder head can be alleviated.

According to a second aspect and feature of the present invention, there is provided a cylinder head structure in a multi-cylinder engine, comprising a collecting exhaust port which is comprised of exhaust port sections extending from a plurality of combustion chambers arranged along a cylinder array, respectively, and integrally collected together in an exhaust collecting section defined within a cylinder head, wherein the structure includes a protrusion formed on a side surface of the cylinder head to project in an arch shape outside a side surface of a cylinder block to which the cylinder head is coupled, and the exhaust collecting section is formed, so that no water jacket is interposed between a side wall of the protrusion and the exhaust collecting section.

With the above arrangement, the exhaust collecting section is formed with no water jacket interposed between the exhaust collecting section and the side wall of the protrusion projecting in the arch shape from the side surface of the cylinder head. Therefore, the size of the protrusion can be reduced to contribute to the compactness of the cylinder head, as compared with a structure including a water jacket provided outside the exhaust collecting section. Moreover, the rigidity of the cylinder head can be increased by the arch-shaped protrusion. Additionally, no water jacket is provided outside the exhaust collecting section and hence, a core for forming the collecting exhaust port can be inserted into a core for forming a water jacket at the time of casting of the cylinder head, thereby facilitating the casting of the cylinder head without employment of a means causing an increase of cost such as the division of the cores into parts. Further, the weight of the protrusion is decreased and hence, the vibration of the cylinder head can be alleviated.

The above and other objects, features and advantages of the invention will become apparent from the following description of the preferred embodiment taken in conjunction with the accompanying drawings.

BRIEF DESCRIPTION OF THE DRAWINGS

FIGS. 1 to 6 show a first embodiment of the present invention, wherein

FIG. 1 is a vertical sectional view of a head portion of an engine;

FIG. 2 is a sectional view taken along a line 2—2 in FIG. 1;

FIG. 3 is a sectional view taken along a line 3—3 in FIG. 2;

FIG. 4 is a sectional view taken along a line 4—4 in FIG. 2;

FIG. 5 is a view taken in the direction of an arrow 5 in FIG. 2;

FIG. 6 is a sectional view taken along a line 6—6 in FIG. 5;

FIGS. 7 to 9 show a second embodiment of the present invention, wherein

FIG. 7 is a view similar to FIG. 2, but according to the second embodiment;

FIG. 8 is a sectional view taken along a line 8—8 in FIG. 7;

FIG. 9 is a sectional view of a mold forming a sand core;

FIG. 13 being a view similar to FIG. 2, and FIG. 14 being a view taken in the direction of an arrow 14 in FIG. 13;

FIGS. 16 to 18 show an eighth embodiment of the present invention, wherein FIG. 16 is a vertical sectional view of an engine;

FIG. 17 is a view taken in the direction of an arrow 17 in FIG. 16;

FIG. 18 is a sectional view taken along a line 18—18 in FIG. 17;

DESCRIPTION OF THE PREFERRED EMBODIMENTS

A first embodiment of the present invention will now be described with reference to FIGS. 1 to 6.

Figure 1:
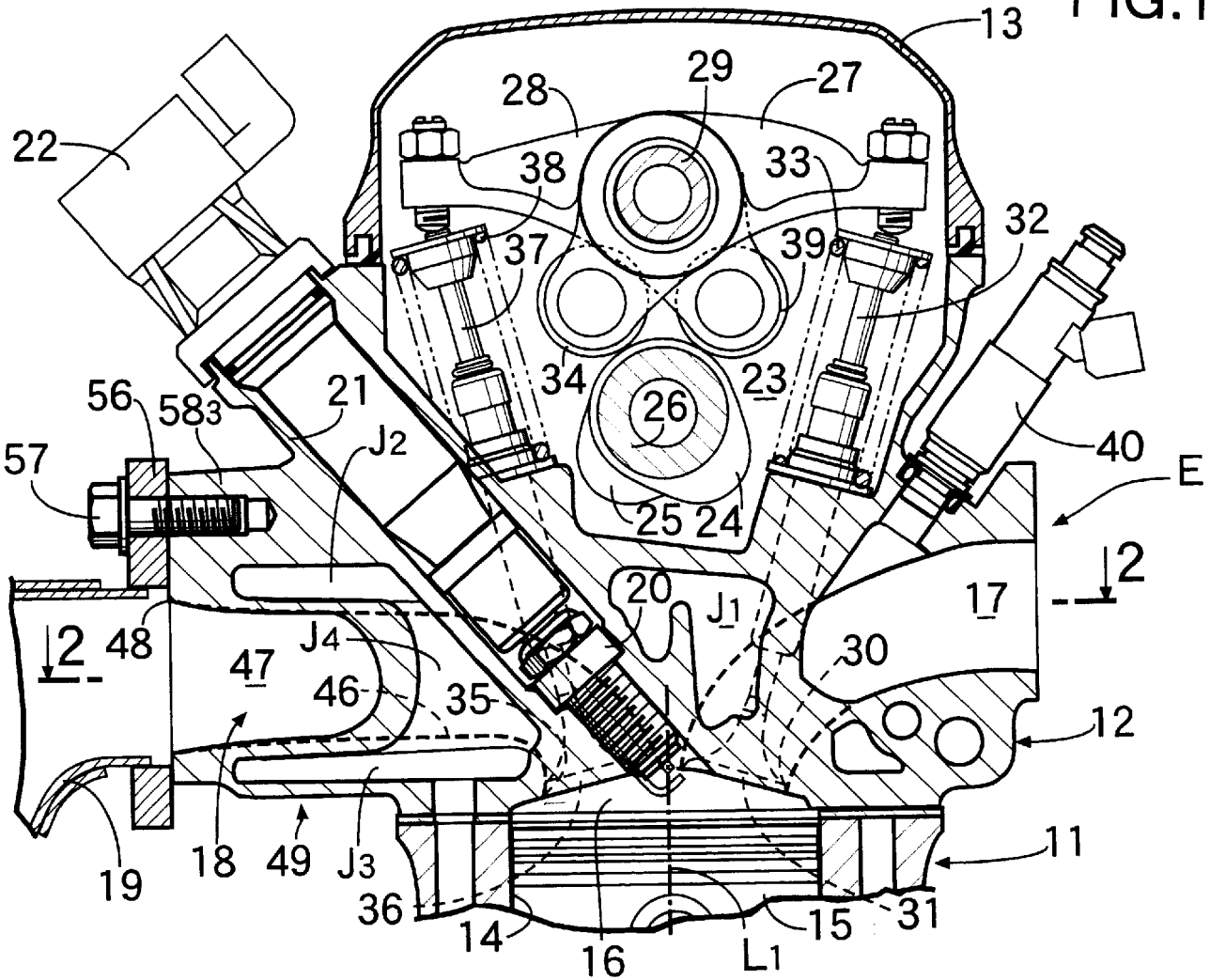

Referring to FIG. 1, a serial or in-line type 3-cylinder engine E includes a cylinder head 12 coupled to an upper surface of a cylinder block 11, and a head cover 13 is coupled to an upper surface of the cylinder head 12. Pistons 15 are slidably received in three cylinders 14 defined in the cylinder block 11, respectively, and combustion chambers 16 are defined below a lower surface of the cylinder head 12 to which upper surfaces of the pistons 15 are opposed. Intake ports 17 connected to the combustion chambers 16 open into a side surface of the cylinder head 12 on the intake side, and a collecting exhaust port 18 connected to the combustion chambers 16 opens into a side surface of the cylinder head 12 on the exhaust side, an exhaust pipe 19 being coupled to the opening of the collecting exhaust port 18. Spark plug insertion tubes 21 for attachment and removal of spark plugs 20 are integrally formed in the cylinder head 12. The spark plug insertion tubes 21 are inclined, so that their upper ends are closer to the collecting exhaust port 18, with respect to a cylinder axis $L_1$. The spark plug 20 facing the combustion chamber 16 is mounted at a lower end of each of the spark plug insertion tubes 21, and an ignition coil 22 is mounted at an upper end of each of the spark plug insertion tubes 21.

A valve operating chamber 23 is defined in an upper portion of the cylinder head 12 and covered with the head cover 13. Provided in the valve operating chamber 23 are a cam shaft 26 including intake cams 24 and exhaust cams 25, and a rocker arm shaft 29, on which intake rocker arms 27 and exhaust rocker arms 28 are swingably carried.

Intake valves 31 for opening and closing two intake valve bores 30 facing each of the combustion chambers 16 have valve stems 32 protruding into the valve operating chamber 23, so that the intake valves 31 are biased in closing directions by valve springs 33 mounted on the protruding portions of the valve stems, respectively. A roller 34 is mounted at one end of each of the intake rocker arms 27 to abut against the intake cam 24, and the other end abuts against an upper end of each of the valve stems 32 of the intake valves 31. Exhaust valves 36 for opening and closing two exhaust valve bores 35 facing each of the combustion chambers 16 have valve stems 37 protruding into the valve operating chamber 23, so that the exhaust valves 36 are biased in closing directions by valve springs 38 mounted on the protruding portions of the valve stems 37, respectively. A roller 39 is mounted at one end of each of the exhaust rocker arms 28 to abut against the exhaust cam 25, and the other end abuts against an upper end of each of the valve stems 37 of the exhaust valves 36.

An injector 40 is mounted in each of the intake ports 17 and directed to the intake valve bore 30 for injecting fuel.

Figure 2:
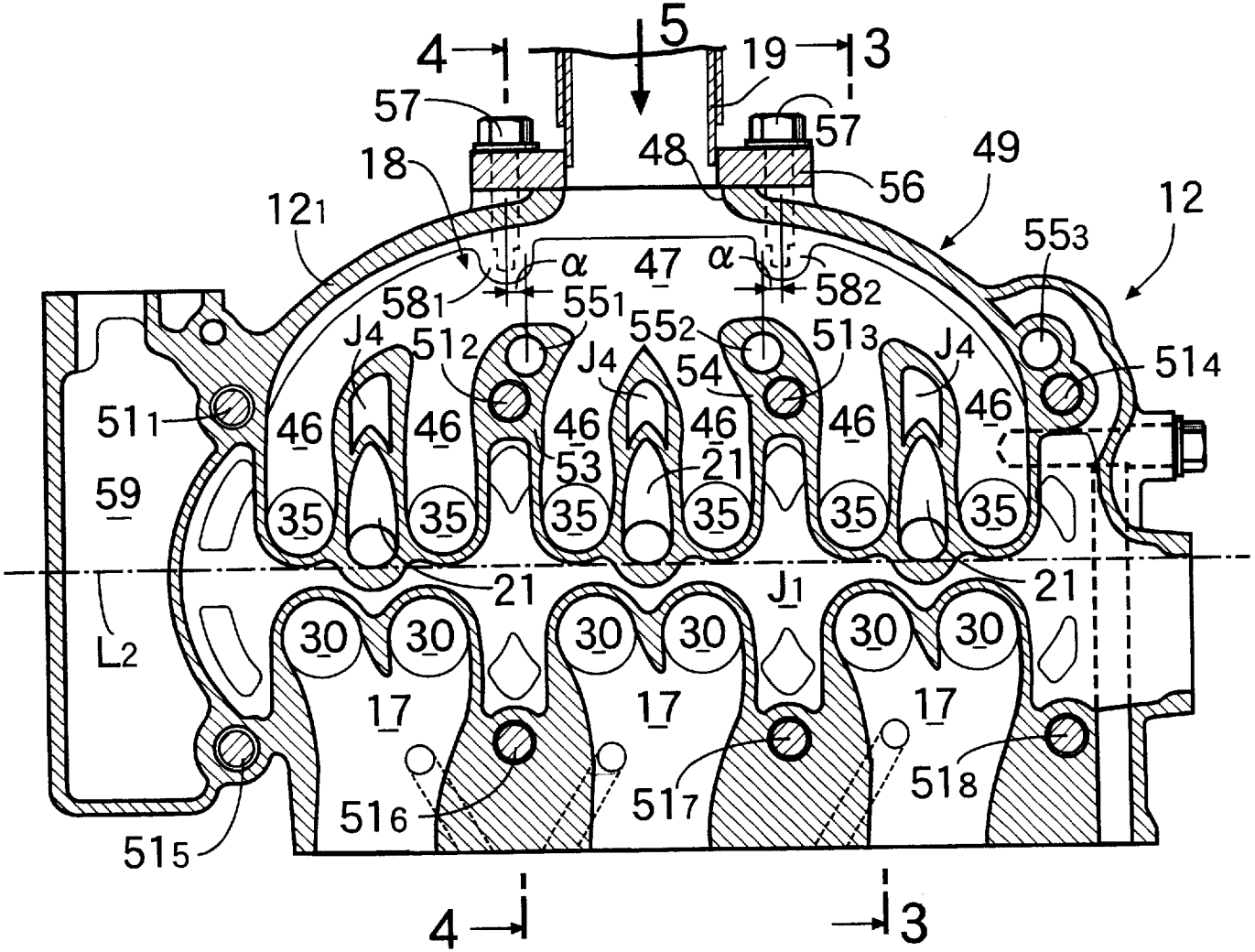
Figure 3:
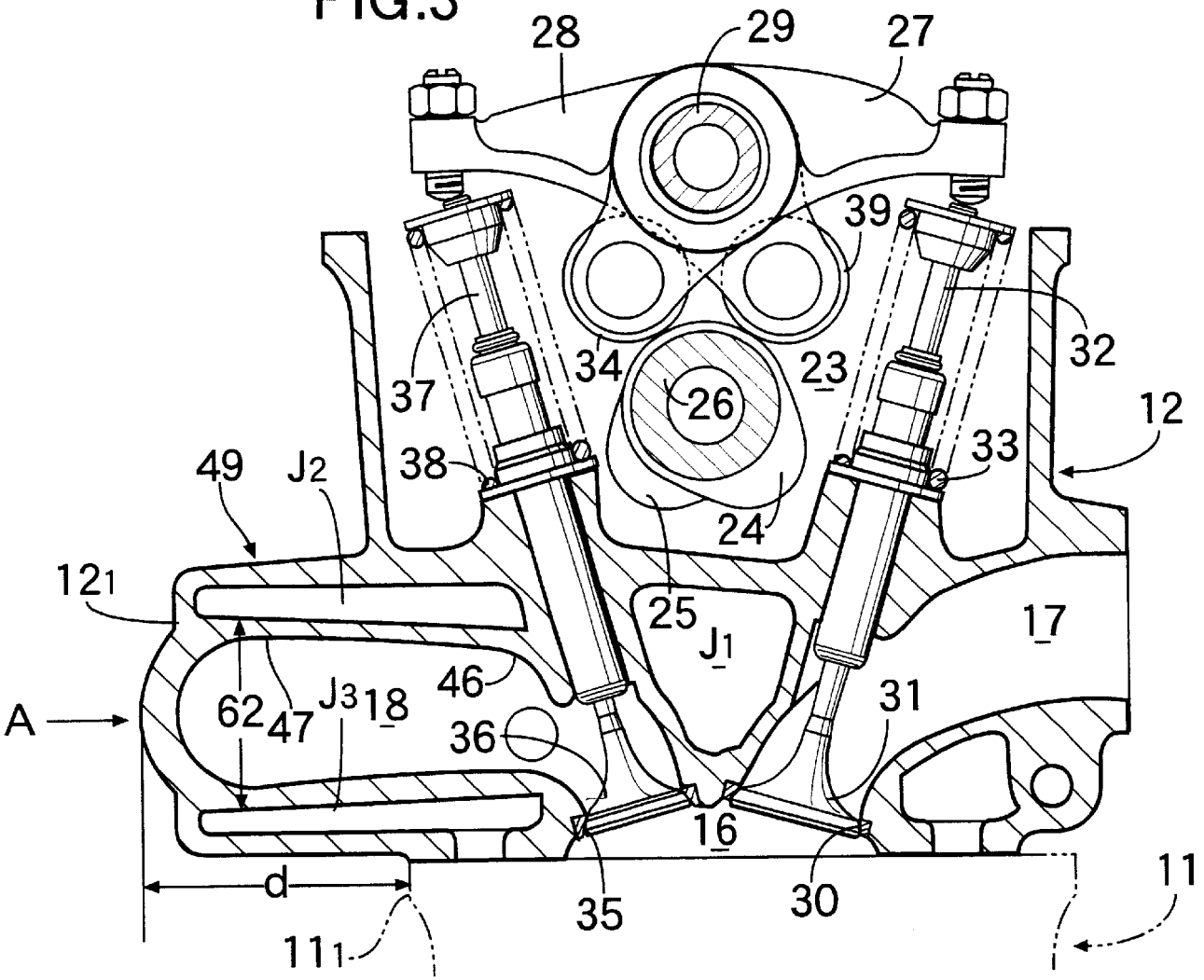

As shown in FIGS. 2 and 3, each of the three intake ports 17 extending from the three combustion chambers 16 is formed into a Y-shape. The three intake ports 17 open independently into the side surface of the cylinder head 12 on the intake side without meeting together. On the other hand, the collecting exhaust port 18 is comprised of a total of six exhaust port sections 46 extending from the three combustion chambers 16, and an arch-shaped exhaust collection portion 47 in which the six exhaust port sections 46 are integrally collected together. An exhaust outlet 48 is defined at a central portion of the exhaust collecting section 47, and the exhaust pipe 19 is coupled to the exhaust outlet 48.

A side wall $12_1$ of the cylinder head 12 on the exhaust side surfaced by the exhaust collecting section 47 is curved into an arch shape to protrude outwards, thereby forming a protrusion 49 projecting from a side wall $11_1$ of the cylinder block 11 by a distance d. Therefore, the exhaust collecting section 47 of the collecting exhaust port 18 defined within the protrusion 49 directly faces a side wall $12_1$ of the protrusion 49 curved into the arch shape with no water jacket interposed therebetween.

Thus, the cylinder head 12 can be made compact, as compared with a structure in which a water jacket is interposed between the exhaust collecting section 47 and the side wall $12_1$, because the exhaust collecting section 47 of the collecting exhaust port 18 defined within the protrusion 49 directly faces the side wall $12_1$ of the protrusion 49 with no water jacket interposed therebetween, as described above. Moreover, the side wall $12_1$ is formed into an arch shape and hence, the width of the lengthwise opposite ends of the cylinder head 12 is decreased. Thus, it is possible not only to provide a further compactness, but also to contribute to an enhancement in rigidity of the cylinder head 12.

Figure 4:
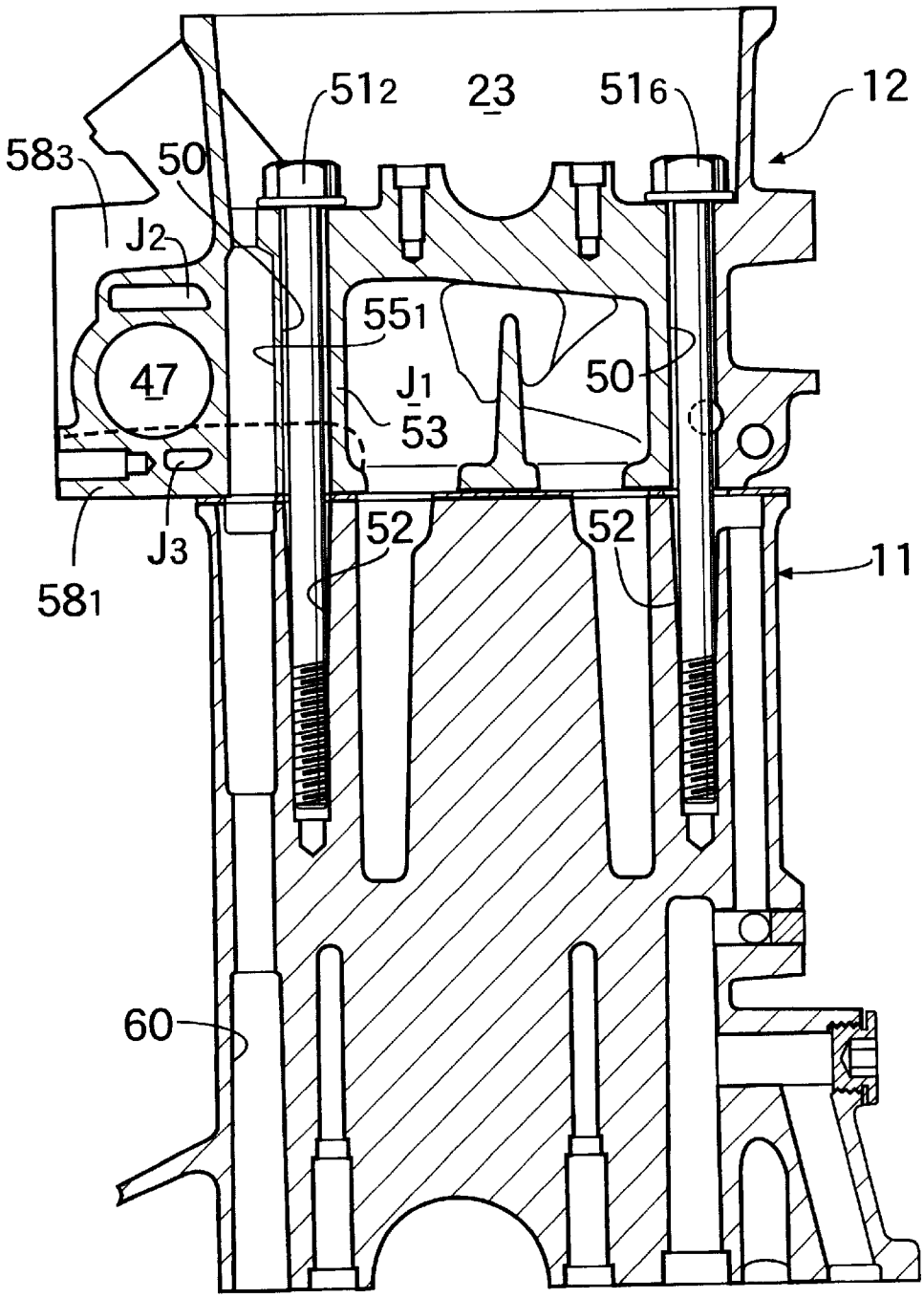

As can be seen from FIGS. 2 to 4, four bolt bores 50 are defined in the cylinder head 12 on the intake and exhaust sides, respectively, so that the cylinder head 12 is fastened to the cylinder block 11 by threadedly inserting eight cylinder head-fastening bolts $\mathbf{51}_1$, $\mathbf{51}_2$, $\mathbf{51}_3$, $\mathbf{51}_4$, $\mathbf{51}_5$, $\mathbf{51}_6$, $\mathbf{51}_7$ and $\mathbf{51}_8$ inserted from above in a total of eight bolt bores 50 into bolt bores 52 defined in the cylinder block 11.

Two wall portions 53 and 54 extend within the collecting exhaust port 18, so that the central cylinder 14 and the cylinders 14 on opposite sides of the central cylinder 14 are partitioned from each other. Two cylinder head-fastening bolts $\mathbf{51}_2$ and $\mathbf{51}_3$ are passed through the two wall portions 53 and 54. Oil return passages $\mathbf{55}_1$ and $\mathbf{55}_2$ extend through tip ends of the two wall portions 53 and 54, i.e., through those portions of the two wall portions 53 and 54 which are closer to the exhaust collecting section 47 from the two cylinder head-fastening bolts $\mathbf{51}_2$ and $\mathbf{51}_3$.

The two wall portions 53 and 54 are curved, so that they extend in the direction of an exhaust gas flowing within the collecting exhaust port 18, i.e., they are directed to the exhaust outlet 48 located centrally. Therefore, the two oil return passages $\mathbf{55}_1$ and $\mathbf{55}_2$ are offset toward the exhaust outlet 48 with respect to the two cylinder head fastening bolts $\mathbf{51}_2$ and $\mathbf{51}_3$ adjacent the two oil return passages $\mathbf{55}_1$ and $\mathbf{55}_2$. The above-described arrangement of the oil return passages $\mathbf{55}_1$ and $\mathbf{55}_2$ and the cylinder head fastening bolts $\mathbf{51}_2$ and $\mathbf{51}_3$ ensures that an exhaust gas can be allowed to flow within the collecting exhaust port 18, whereby the exhaust resistance can be reduced, while avoiding an increase in size of the cylinder head 12.

The exhaust outlet 48 in the cylinder head 12 is provided with three boss portions $\mathbf{58}_1$, $\mathbf{58}_2$ and $\mathbf{58}_3$, into which three bolts 57 for fastening a mounting flange 56 of the exhaust pipe 19 are threadedly inserted, and the two oil return passages $\mathbf{55}_1$ and $\mathbf{55}_2$ are offset by a distance a in the direction of a cylinder array line $L_2$ with respect to the two boss portions $\mathbf{58}_1$ and $\mathbf{58}_2$ spaced apart from each other in the direction of the cylinder array line $L_2$. Thus, it is possible to dispose the wall portion 53 and the boss portion $\mathbf{58}_1$ at locations closer to each other and the wall portion 54 and the boss portion $\mathbf{58}_2$ at locations closer to each other, thereby avoiding a reduction in flowing cross sectional area of the exhaust collecting section 47 to prevent an increase of the exhaust resistance, while enhancing the rigidity of the cylinder head 12 in the vicinity of the exhaust outlet 48.

The number of the exhaust pipe 19 is one and hence, the two boss portions $\mathbf{58}_1$ and $\mathbf{58}_2$ located below as viewed from above cannot be hidden below the exhaust pipe 19 and thus, it is possible to easily perform the operation of fastening the bolts 57 to the two boss portions $\mathbf{58}_1$ and $\mathbf{58}_2$. In addition, by providing the one boss portion $\mathbf{58}_3$ above the exhaust pipe 19, the exhaust pipe 19 can be fixed at three points to enhance the mounting rigidity, while ensuring the operability of fastening the bolts 57.

A cam driving chain chamber 59, in which a cam driving chain (not shown) is accommodated, is defined at lengthwise one end of the cylinder head 12. A third oil return passage $\mathbf{55}_3$ is defined in the vicinity of the cylinder head fastening bolt $\mathbf{51}_4$ located on the side opposite from the cam driving chain chamber 59. The three oil return passages $\mathbf{55}_1$, $\mathbf{55}_2$ and $\mathbf{55}_3$ ensure that the valve operating chamber 23 provided in the cylinder head 12 communicates with an oil pan (not shown) through oil return passages 60 provided in the cylinder block 11.

In this way, the two oil return passages $\mathbf{55}_1$ and $\mathbf{55}_2$ are disposed in a region surrounded by the exhaust ports 46 in adjacent ones of the cylinders 14 and the exhaust collecting section 47. Therefore, the oil return passages $\mathbf{55}_1$ and $\mathbf{55}_2$ can be defined on the exhaust side of the cylinder head 12 without interference with the collecting exhaust port 18, whereby the oil within the valve operating chamber 23 in the cylinder head 12 can reliably be returned to the oil pan. Moreover, the oil flowing through the oil return passages $\mathbf{55}_1$ and $\mathbf{55}_2$ at a low temperature can be heated by an exhaust gas flowing through the collecting exhaust port 18 and hence, the temperature of the oil can be raised without providing a special oil heater, whereby the friction resistance in each of lubricated portions can be reduced.

Figure 5:
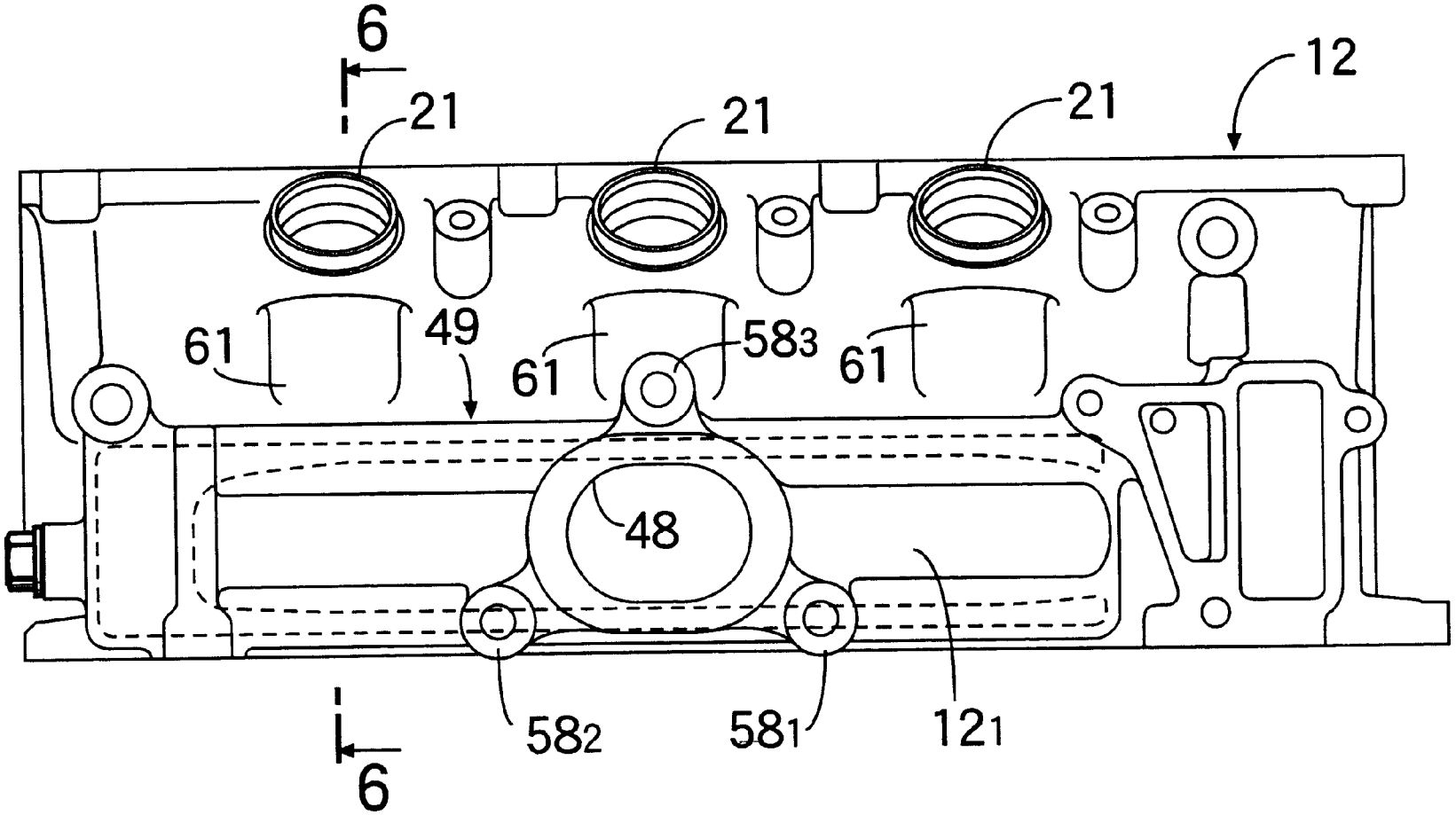
Figure 6:
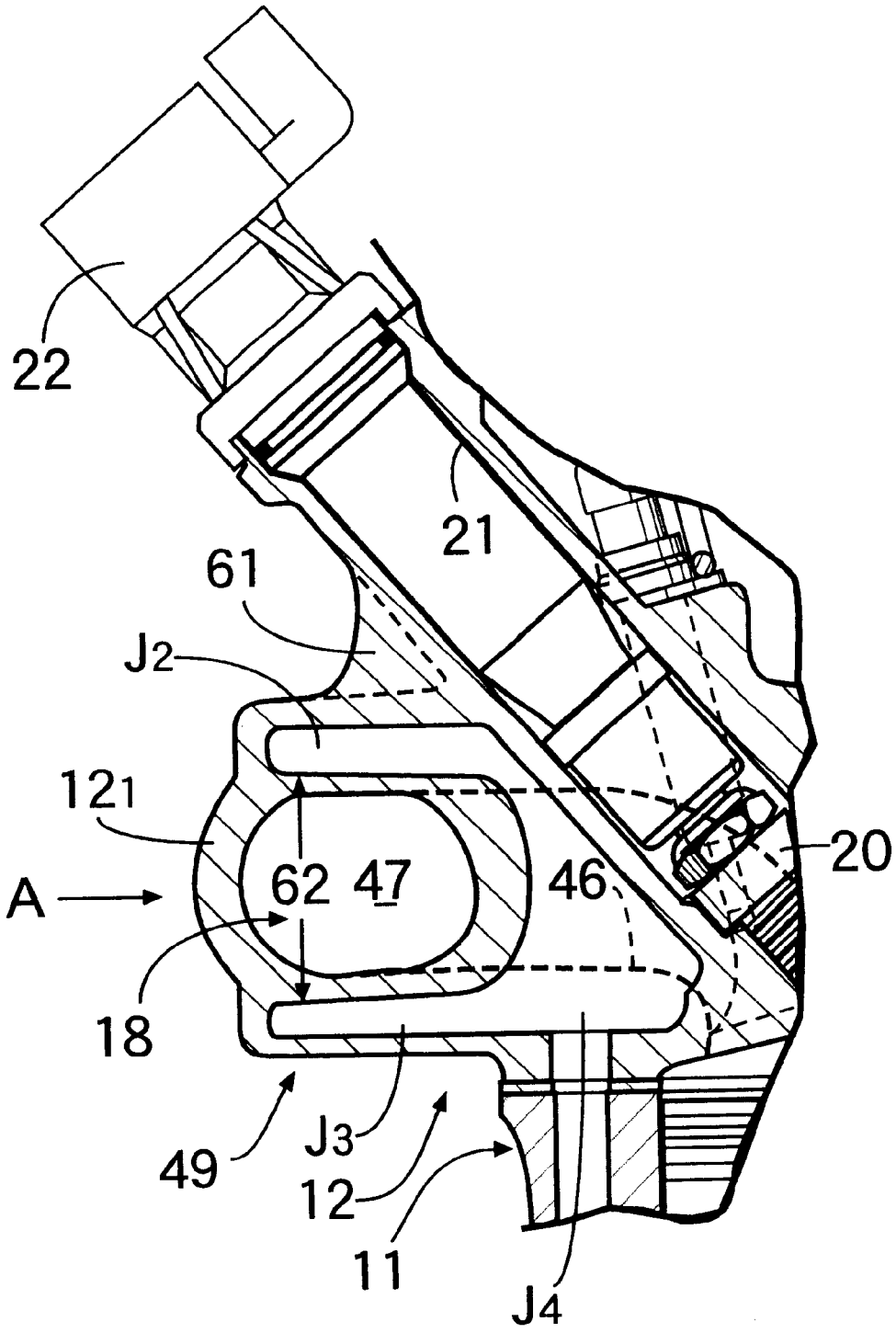

As can be seen from FIGS. 5 and 6, the three spark plug insertion tubes 21 disposed to become inclined toward the exhaust side of the cylinder head 12 are connected with an upper surface of the protrusion 49 by reinforcing walls 61 triangular in section. The rigidity of the protrusion 49 can be enhanced by the reinforcing walls 61, and the vibration of the protrusion 49 during operation of the engine E can be effectively inhibited.

As shown in FIGS. 1 to 4, a water jacket $J_1$ is defined within the cylinder head 12 to extend along the cylinder array line $L_2$. Water jackets $J_2$ and $J_3$ covering upper and lower surfaces of the collecting exhaust port 18 are also provided in the protrusion 49 of the cylinder head 12, which is heated to a high temperature by an exhaust gas flowing through the collecting exhaust port 18. The upper and lower water jackets $J_2$ and $J_3$ communicate with each other through three water jackets $J_4$ at a portion which does not interfere with the exhaust ports 46, i.e., in the vicinity of the three spark plug insertion tubes 21.

By covering the peripheral region of the collecting exhaust port 18 with the water jackets $J_1$, $J_2$, $J_3$ and $J_4$, as described above, the exhaust side of the cylinder head 12 liable to be heated to a high temperature can be effectively cooled. Especially, the water jacket $J_2$ is interposed between ignition coils 22 serving as auxiliaries easily affected by a heat and the collecting exhaust port 18 and hence, the transfer of a heat to the ignition coils 22 can be effectively inhibited (see FIG. 6).

As can be seen from FIGS. 3 and 6, an outer portion of the collecting exhaust port 18 is opposed directly to the side wall $\mathbf{12}_1$ of the protrusion 49 with no water jacket interposed therebetween. Therefore, it is possible to simplify the structures of cores for forming the water jackets $J_2$, $J_3$ and $J_4$ and the collecting exhaust port 18 during formation of the cylinder head 12 in a casting manner.

The reason is as follows: the cores for forming the water jackets $J_2$, $J_3$ and $J_4$ are first inserted into a mold in the direction of an arrow A and then, the core for forming the collecting exhaust port 18 is inserted into the mold in the direction of the arrow A. In this case, an opening 62 exists between the upper and lower water jackets $J_2$ and $J_3$ and hence, the core for forming the collecting exhaust port 18 can be inserted through the opening 62. The upper and lower water jackets $J_2$ and $J_3$ are connected to each other by the three water jackets $J_3$, but the cores corresponding to the three water jackets $J_4$ are meshed alternately with those portions of the core for forming the collecting exhaust port 18 which corresponding to the six exhaust ports 46 and hence, the interference of both the cores with each other is avoided (see FIG. 2).

In this manner, the cores for forming the water jackets $J_2$, $J_3$ and $J_4$ or the core for forming the collecting exhaust port 18 can be assembled to the mold without being divided. Therefore, when the cylinder head 12 is produced in the casting manner, the cost can be reduced.

A second embodiment of the present invention will now be described with reference to FIGS. 7 to 9.

Figure 7:
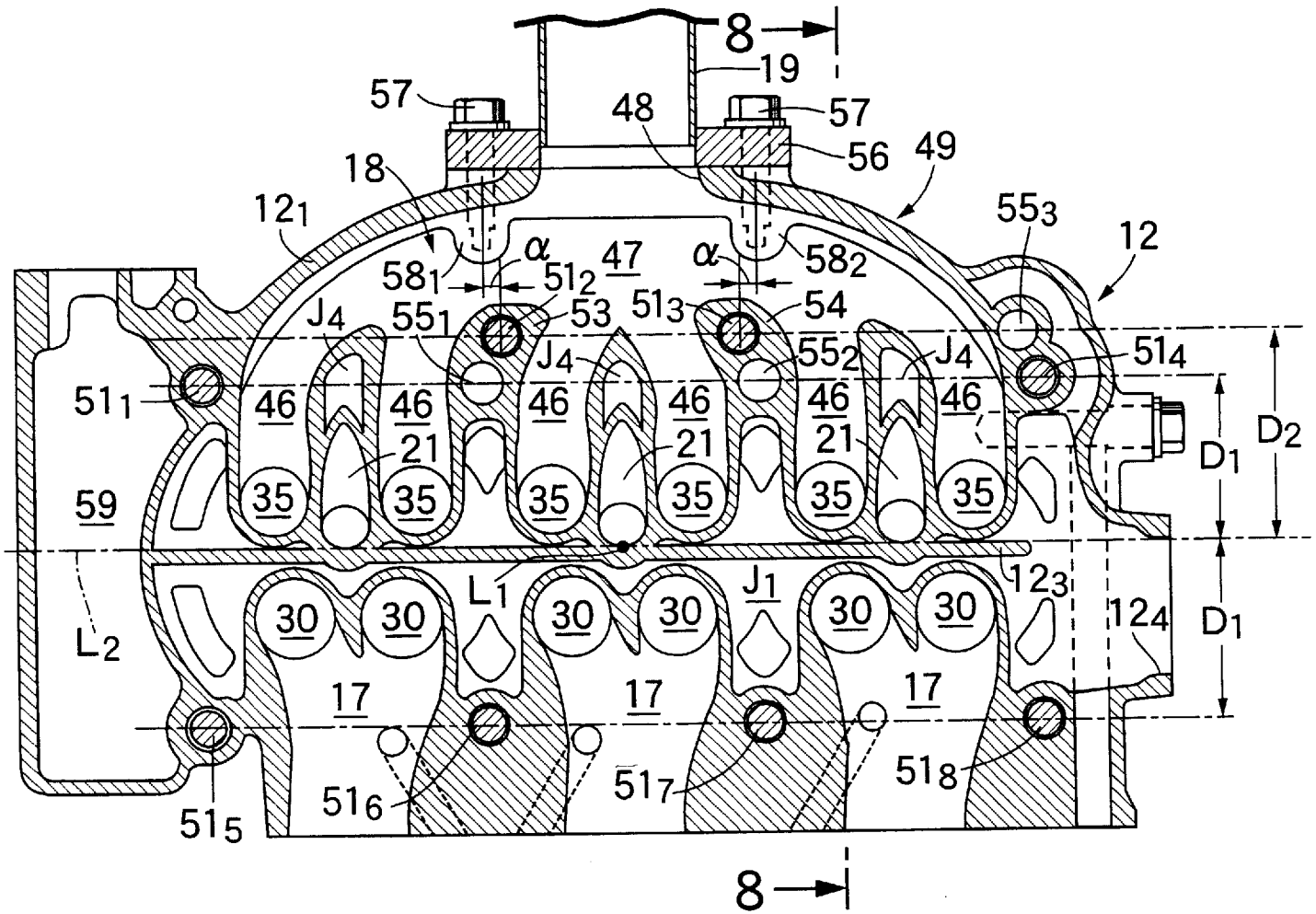

As can be seen from FIG. 7, the four cylinder head fastening bolts $\mathbf{51}_5$, $\mathbf{51}_6$, $\mathbf{51}_7$ and $\mathbf{51}_8$ disposed on the intake side are disposed on a straight line spaced through a distance $D_1$ apart from the cylinder array line $L_2$ intersecting the cylinder axis $L_1$ of the three cylinders 14. On the other hand, in the four cylinder head fastening bolts $\mathbf{51}_1$, $\mathbf{51}_2$, $\mathbf{51}_3$ and $\mathbf{51}_4$ disposed on the exhaust side, the distance of the two cylinder head, fastening bolts $\mathbf{51}_1$ and $\mathbf{51}_4$ at opposite ends from the cylinder array line $L_2$ is $D_1$, but the distance of the cylinder head fastening bolts $\mathbf{51}_2$ and $\mathbf{51}_3$ from the cylinder array line $L_2$ is $D_2$ larger than $D_1$. In other words, the distance between the cylinder array line $L_2$ and two cylinder head fastening bolts $\mathbf{51}_6$ and $\mathbf{51}_7$, on the intake side, of the four cylinder head fastening bolts $\mathbf{51}_2$, $\mathbf{51}_3$, $\mathbf{51}_6$ and $\mathbf{51}_7$ disposed around an outer periphery of the central cylinder 14 closest to the exhaust collecting section 47 of the collecting exhaust port 18 is set at $D_1$, while the distance between the cylinder array line $L_2$ and the two cylinder head fastening bolts $\mathbf{51}_2$ and $\mathbf{51}_3$ on the exhaust side is set at $D_2$ larger than $D_1$.

The two wall portions 53 and 54 extend within the collecting exhaust port 18 to partition the central cylinder 14 and the cylinders 14 on the opposite sides from each other, and the two cylinder head fastening bolts $\mathbf{51}_2$ and $\mathbf{51}_3$ are passed through the two wall portions 53 and 54, respectively. The oil return passages $\mathbf{55}_1$ and $\mathbf{55}_2$ extend through base end portions of the two wall portions 53 and 54, i.e., through those portions of the two wall portions 53 and 54 which are on the side of the cylinder array line $L_2$ from the two cylinder head fastening bolts $\mathbf{51}_2$ and $\mathbf{51}_3$. The two wall portions 53 and 54 are curved, so that they extend in the direction of an exhaust gas flowing within the collecting exhaust port 18, i.e., they are directed to the exhaust outlet 48 located centrally. Therefore, the two cylinder head fastening bolts $\mathbf{51}_2$ and $\mathbf{51}_3$ are offset toward the exhaust outlet 48 with respect to the two oil return passages $\mathbf{55}_1$ and $\mathbf{55}_2$ adjacent to the two cylinder head fastening bolts $\mathbf{51}_2$ and $\mathbf{51}_3$.

The protrusion 49 formed to project sideways from the cylinder head 12 has an insufficient rigidity, so that the vibration is liable to be generated during operation of the engine E. However, by disposing the two cylinder head fastening bolts $\mathbf{51}_2$ and $\mathbf{51}_3$ close to the exhaust collecting section 47 having a largest projection amount, so that they are offset toward the exhaust collecting section 47, the protrusion 49 can be firmly fastened to the cylinder block 11, whereby the rigidity can effectively be increased, and the generation of the vibration can be inhibited. In addition, it is possible to ensure the sealability of coupled surfaces of the cylinder head 12 and the cylinder block 11, because the vibration of the protrusion 49 is inhibited.

Thus, the above-described disposition of the oil return passages $\mathbf{55}_1$ and $\mathbf{55}_2$ and the cylinder head fastening bolts $\mathbf{51}_2$ and $\mathbf{51}_3$ ensure that an exhaust gas flows smoothly within the collecting exhaust port 18, whereby the exhaust resistance can be reduced, while avoiding an increase in size of the cylinder head 12.

Figure 8:
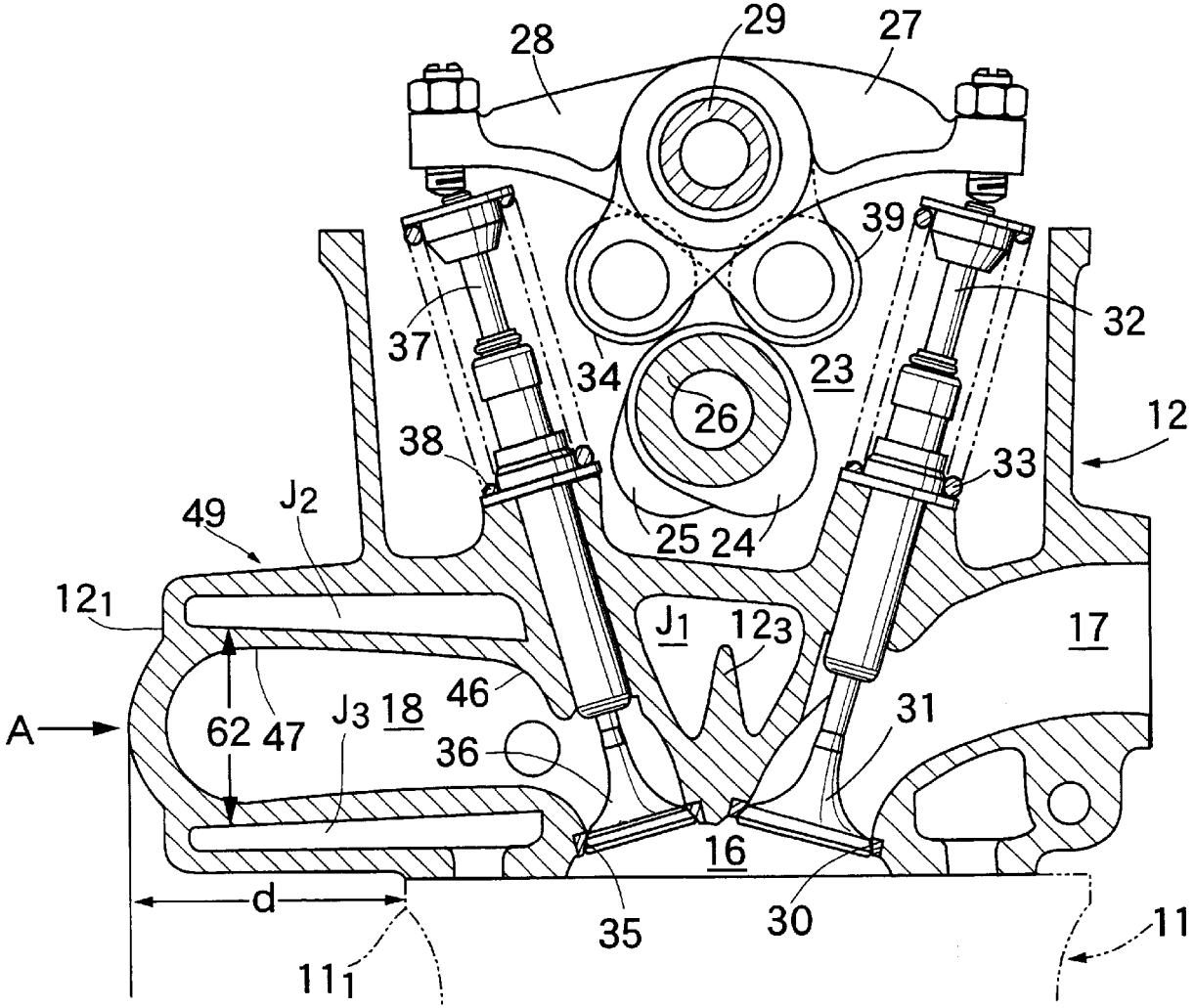
Figure 9:
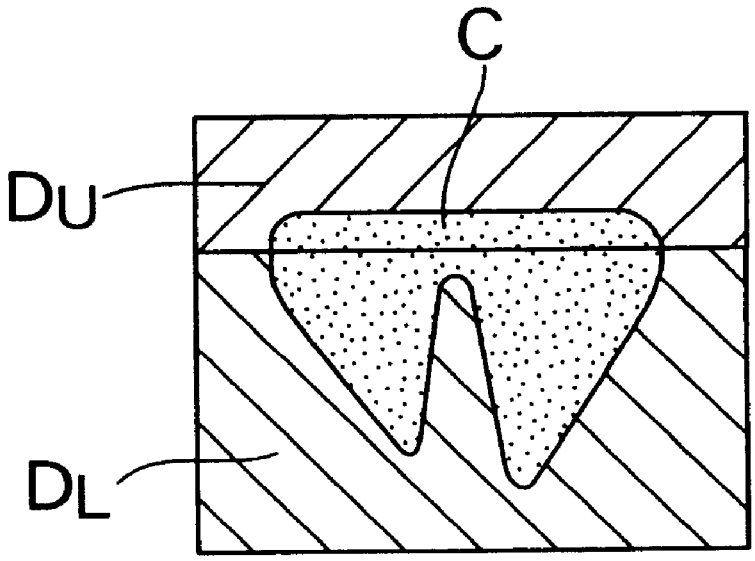

As shown in FIGS. 7 and 8, the water jacket $J_1$ defined centrally in the cylinder head 12 has a heat radiating wall $\mathbf{12}_3$ extending rectilinearly along the cylinder array line $L_2$ therein. The water jacket $J_1$ is formed by a sand core C shown in FIG. 9, when the cylinder head 12 is produced in a casting manner. The sand core C is formed by a mold including a lower die $D_L$ and an upper die $D_U$. Thus, the heat radiating wall $\mathbf{12}_3$ is also formed by the sand core C. In order to facilitate the separation of the dies $D_L$ and $D_U$ after completion of the formation of the sand core C, the heat radiating wall $\mathbf{12}_3$ is formed, so that the thickness is smaller at an upper portion thereof.

Since the heat radiating wall $\mathbf{12}_3$ extending upwards from the lower surface of the water jacket $J_1$ provided in the cylinder head 12 to extend in the direction of arrangement of the combustion chambers 16 above the combustion chambers 16 is provided on the cylinder head 12 continuously in the direction of arrangement of the combustion chambers 16, the area of transfer of heat from the surroundings of the combustion chambers 16 to cooling water can be increased by the heat radiating wall $\mathbf{12}_3$, thereby sufficiently enhancing the radiatability of heat from the surroundings of the combustion chambers 16 to the cooling water. In addition, since the heat radiating wall $\mathbf{12}_3$ is continuous in the direction of arrangement of the combustion chambers 16, the rigidity of the entire cylinder head 12 can be increased.

Further, since the water jacket $J_1$ is formed by the sand core C during production of the cylinder head 12 in the casting manner, and the heat radiating wall $\mathbf{12}_3$ is formed so that the thickness is smaller at an upper portion thereof, the formation of the sand core by the mold is facilitated, and the heat radiating wall $\mathbf{12}_3$ is formed integrally with the cylinder head 12 in the casting manner, leading to a remarkable effect of increasing the rigidity of the cylinder head 12 by the heat radiating wall $\mathbf{12}_3$.

In the second embodiment, a water outlet $\mathbf{12}_4$ of the water jacket $J_1$ is offset toward the intake side with respect to the heat radiating wall $\mathbf{12}_3$. However, if the water outlet $\mathbf{12}_4$ is disposed on an extension line of the heat radiating wall $\mathbf{12}_3$, the heat radiating wall $\mathbf{12}_3$ can be extended to the utmost toward the water outlet $\mathbf{12}_4$, while uniformizing the flowing of the cooling water from the opposite sides of the heat radiating wall $\mathbf{12}_3$ to the water outlet $\mathbf{12}_4$. Therefore, the rigidity of the cylinder head 12 can be further increased, and at the same time, the heat radiatability can be enhanced by the uniformization of the flowing of the cooling water on the opposite sides of the heat radiating wall $\mathbf{12}_3$.

Figure 10:
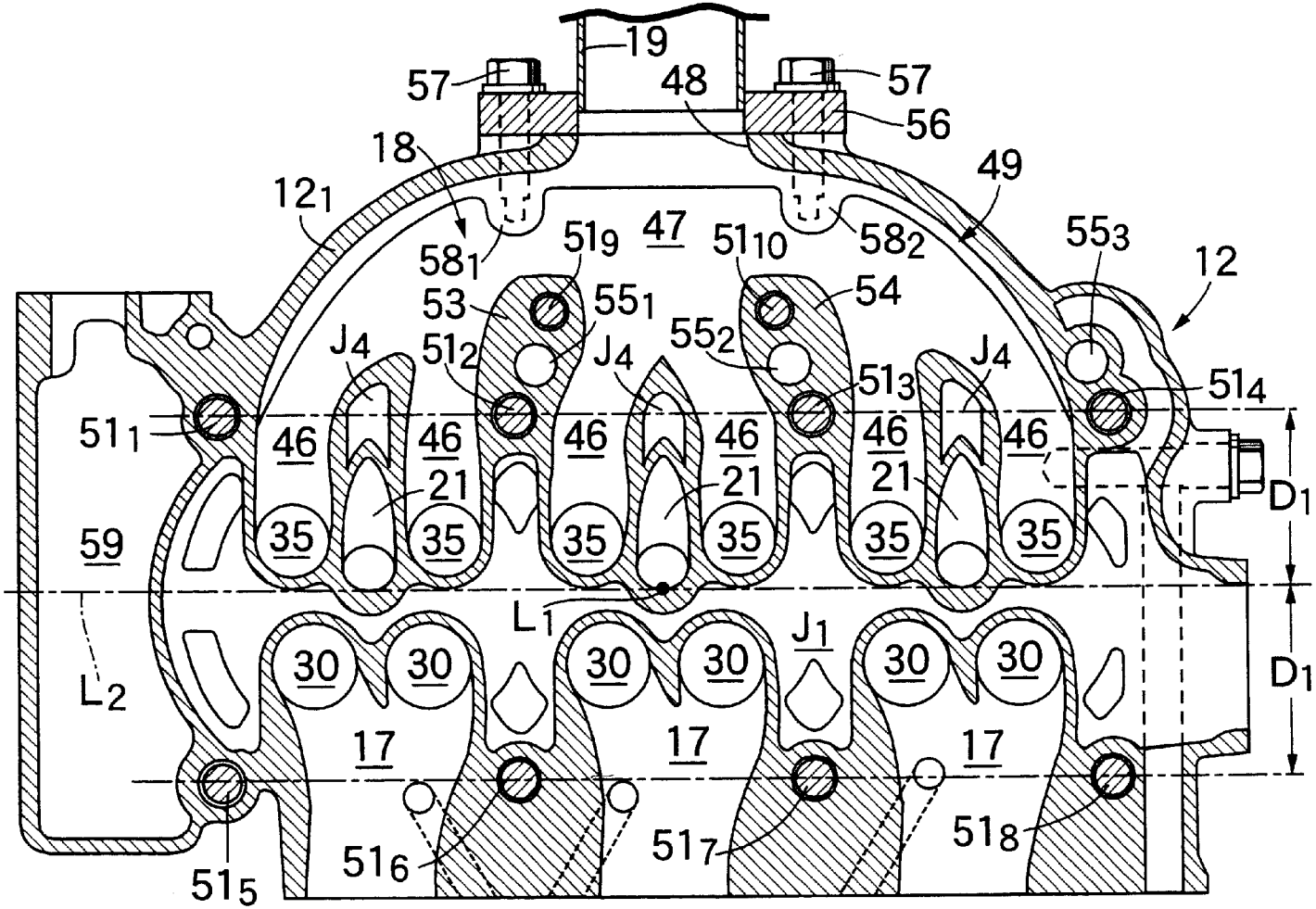
FIG. 10 is a view similar to FIG. 2, but according to a third embodiment of the present invention.

A third embodiment of the present invention will be described below with reference to FIG. 10.

In the third embodiment, the four cylinder head fastening bolts $\mathbf{51}_1$, $\mathbf{51}_2$, $\mathbf{51}_3$ and $\mathbf{51}_4$ disposed on the exhaust side of the cylinder head 12 and four cylinder head fastening bolts $\mathbf{51}_5$, $\mathbf{51}_6$, $\mathbf{51}_7$ and $\mathbf{51}_8$ disposed on the intake side of the cylinder head 12 are all disposed at locations spaced through the distance $D_1$ apart from the cylinder array line $L_2$. Two exhaust collecting section fastening bolts $\mathbf{51}_9$ and $\mathbf{5}_{10}$ are disposed in two wall portions 53 and 54 partitioning the central cylinder 14 and the cylinders 14 on the opposite sides from each other, so that the bolts $\mathbf{51}_9$ and $\mathbf{51}_{10}$ are located outside oil return passages $\mathbf{55}_1$ and $\mathbf{55}_2$ (at locations farther from the cylinder array line $L_2$). The two exhaust collecting section fastening bolts $\mathbf{51}_9$ and $\mathbf{51}_{10}$ on the side of the exhaust collecting section 47, which are additionally provided in this embodiment, have a diameter smaller than those of the two cylinder head fastening bolts $\mathbf{51}_2$ and $\mathbf{51}_3$ on the side of the combustion chamber 16. This can contribute to the avoidance of an increase in size of the cylinder head 12 and to a reduction in exhaust resistance.

In the above manner, the two exhaust collecting section fastening bolts $\mathbf{51}_9$ and $\mathbf{5}_{10}$ are additionally provided on the exhaust side of the cylinder head 12 to couple the exhaust collecting section 47 to the cylinder block 11. Therefore, it is possible not only to increase the rigidity of the protrusion 49 to effectively inhibit the generation of the vibration, but also to ensure the sealability of the coupled surfaces of the cylinder head 12 and the cylinder block 11. Moreover, since each of the two oil return passages $55_1$ and $55_2$ is interposed between the two bolts $51_2$ and $51_9$ as well as $51_3$ and $51_{10}$, respectively, the sealability of the oil return passages $55_1$ and $55_2$ is also enhanced.

The two wall portions 53 and 54 are curved toward the central exhaust outlet 48 to extend along the direction of an exhaust gas flowing within the collecting exhaust port 18, and the two cylinder head fastening bolts $51_2$ and $51_3$, the two oil return passages $55_1$ and $55_2$ and the two exhaust collecting section fastening bolts $51_9$ and $51_{10}$ are disposed in the wall portions 53 and 54 to extend from a location closer to the cylinder array line $L_2$ or a central cylinder axis $L_1$ to a location farther from the cylinder array line $L_2$ or the central cylinder axis $L_1$. Therefore, it is possible to ensure that the exhaust gas flows smoothly within the collecting exhaust port 18, whereby the exhaust resistance can be reduced, while avoiding an increase in size of the cylinder head 12.

Figure 11:
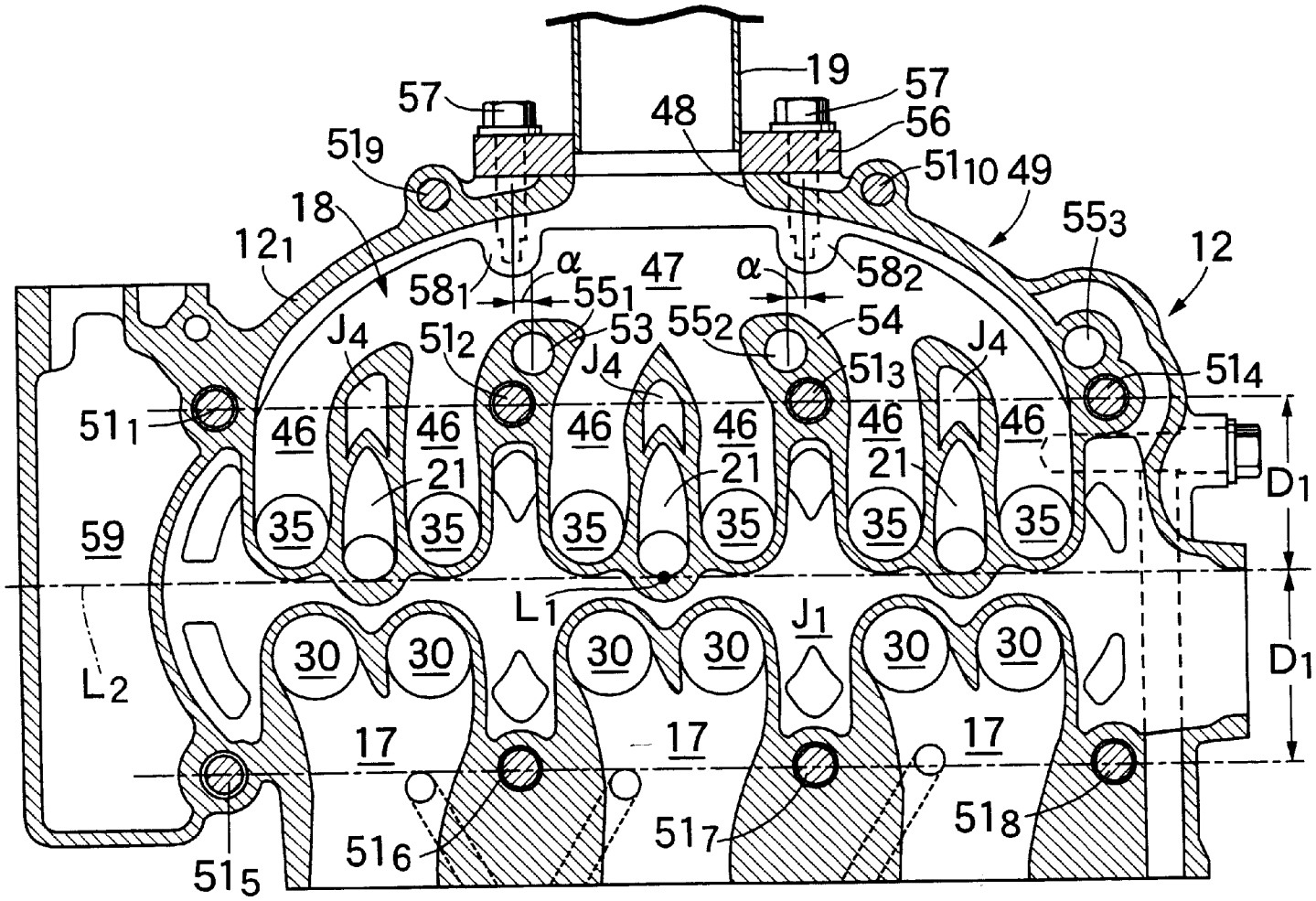
FIG. 11 is a view similar to FIG. 2, but according to a fourth embodiment of the present invention.

A fourth embodiment of the present invention will be described below with reference to FIG. 11.

Even in the fourth embodiment, the four cylinder head fastening bolts $51_1$, $51_2$, $51_3$ and $51_4$ disposed on the exhaust side of the cylinder head 12 and four cylinder head fastening bolts $51_5$, $51_6$, $51_7$ and $51_8$ disposed on the intake side of the cylinder head 12 are all disposed at locations spaced through the distance $D_1$ apart from the cylinder array line $L_2$. On opposite sides of the exhaust outlet 48 of the protrusion 49 of the cylinder head 12, the protrusion 49 and a protrusion projecting from the side wall $11_1$ of the cylinder block 11 are coupled to each other by two exhaust collecting section fastening bolts $51_9$ and $51_{10}$ each having a smaller diameter. In this manner, the outermost portion of the protrusion 49 of the cylinder head 12 is coupled to the protrusion of the cylinder block 11 by the two exhaust collecting section fastening bolts $51_9$ and $51_{10}$ and hence, the rigidity of the protrusion 49 of the cylinder head 12 can be effectively increased, whereby the generation of the vibration can be reliably prevented. Moreover, each of the two exhaust collecting section fastening bolts $51_9$ and $51_{10}$ on the side of the exhaust collecting section 47 has a diameter smaller than those of the two cylinder head fastening bolts $51_2$ and $51_3$ on the side of the combustion chamber 16 and hence, an increase in size of the cylinder head 12 can be prevented.

A fifth embodiment of the present invention will be described below with reference to FIG. 12.

Figure 12:
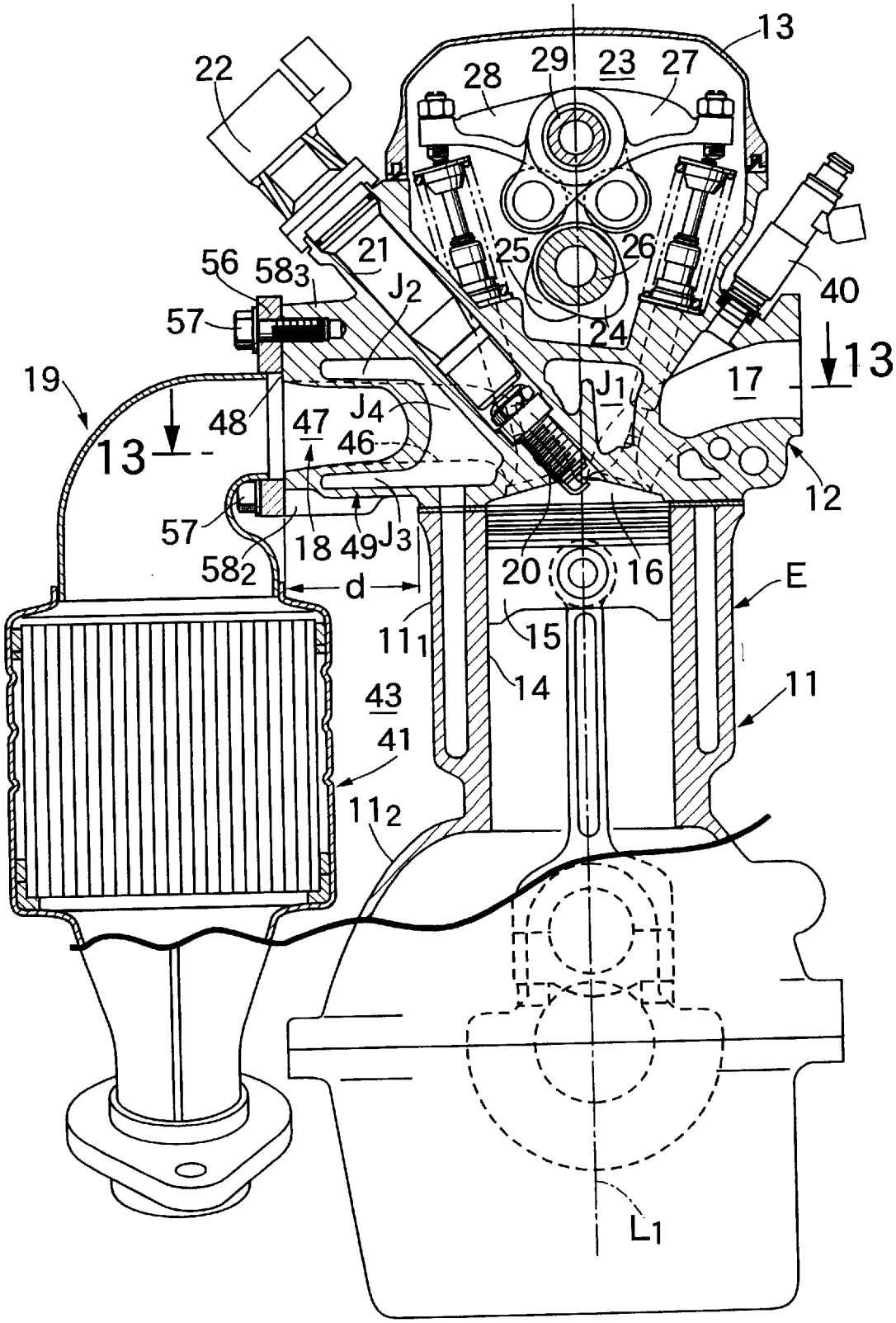
FIG. 12 is a vertical sectional view of an engine according to a fifth embodiment of the present invention.

As can be seen from FIG. 12, the exhaust pipe 19 coupled to the exhaust outlet 48 of the collecting exhaust port 18 defined in the protrusion 49 of the cylinder head 12 is bent downwards at 90°, and a substantially cylindrical exhaust emission control catalyst 41 is mounted in the exhaust pipe 19. A portion of the exhaust emission control catalyst 41 disposed vertically to extend along a side surface of the cylinder block 11 extends below the protrusion 49 of the cylinder head 12. Thus, such portion of the exhaust emission control catalyst 41 overlaps with the protrusion 49 below the latter, as viewed in the direction of the cylinder axis $L_1$.

In this way, at least a portion of the exhaust emission control catalyst 41 is accommodated in a recess 43 which is defined by a lower surface of the protrusion 49 of the cylinder head 12, the side surface of the cylinder block 11 and an upper surface of a crankcase bulge $11_2$ and hence, the entire engine E including the exhaust emission control catalyst 41 can be made compact. Moreover, the exhaust emission control catalyst 41 is disposed at a location extremely near the exhaust outlet 48 of the collecting exhaust port 18 and hence, an exhaust gas having a high temperature can be supplied to the exhaust emission control catalyst 41 to raise the temperature of the exhaust emission control catalyst 41, thereby promoting the activation of the exhaust emission control catalyst 41.

Figure 13:
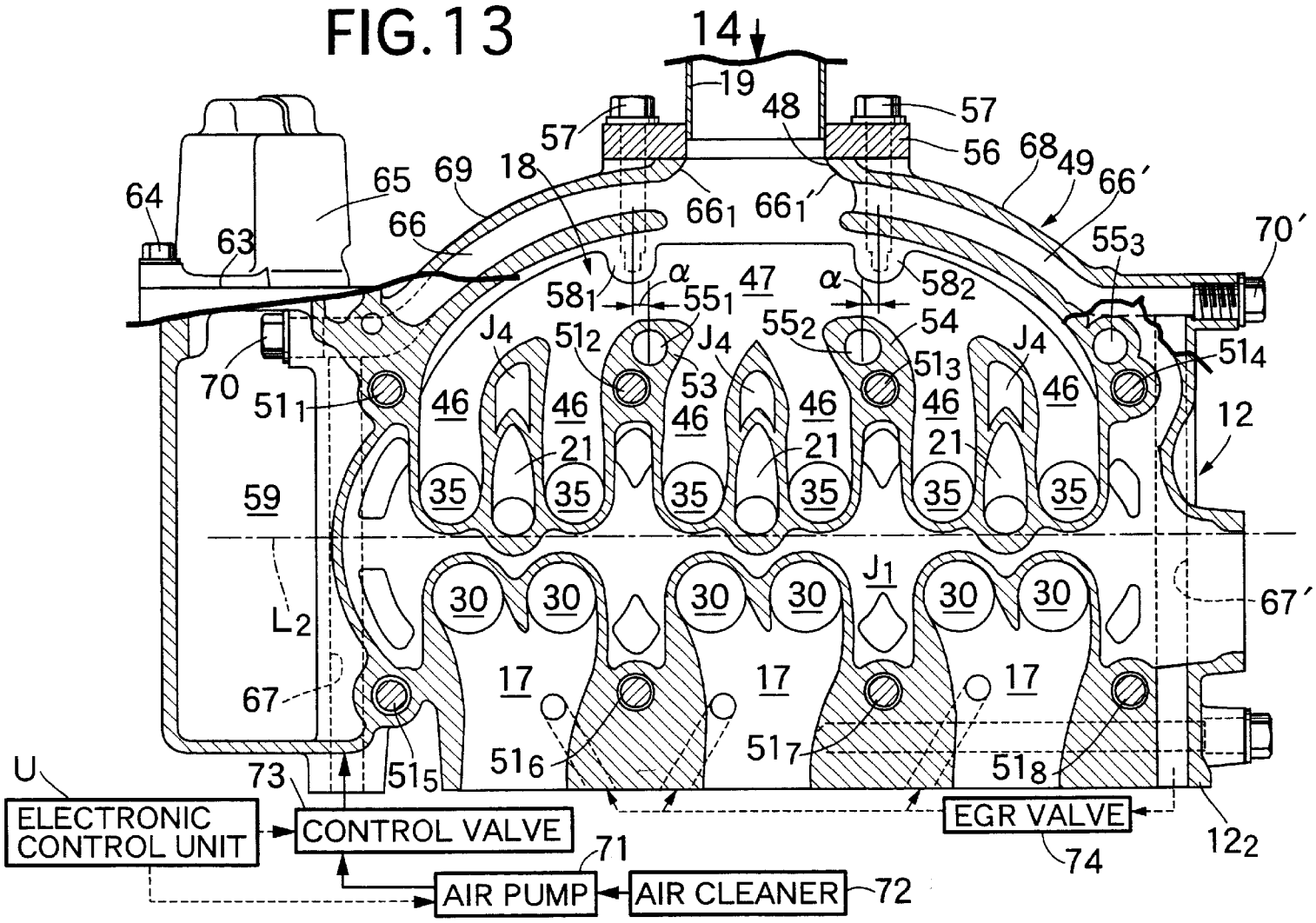
FIGS. 13 and 14 show a sixth embodiment of the present invention.
Figure 14:
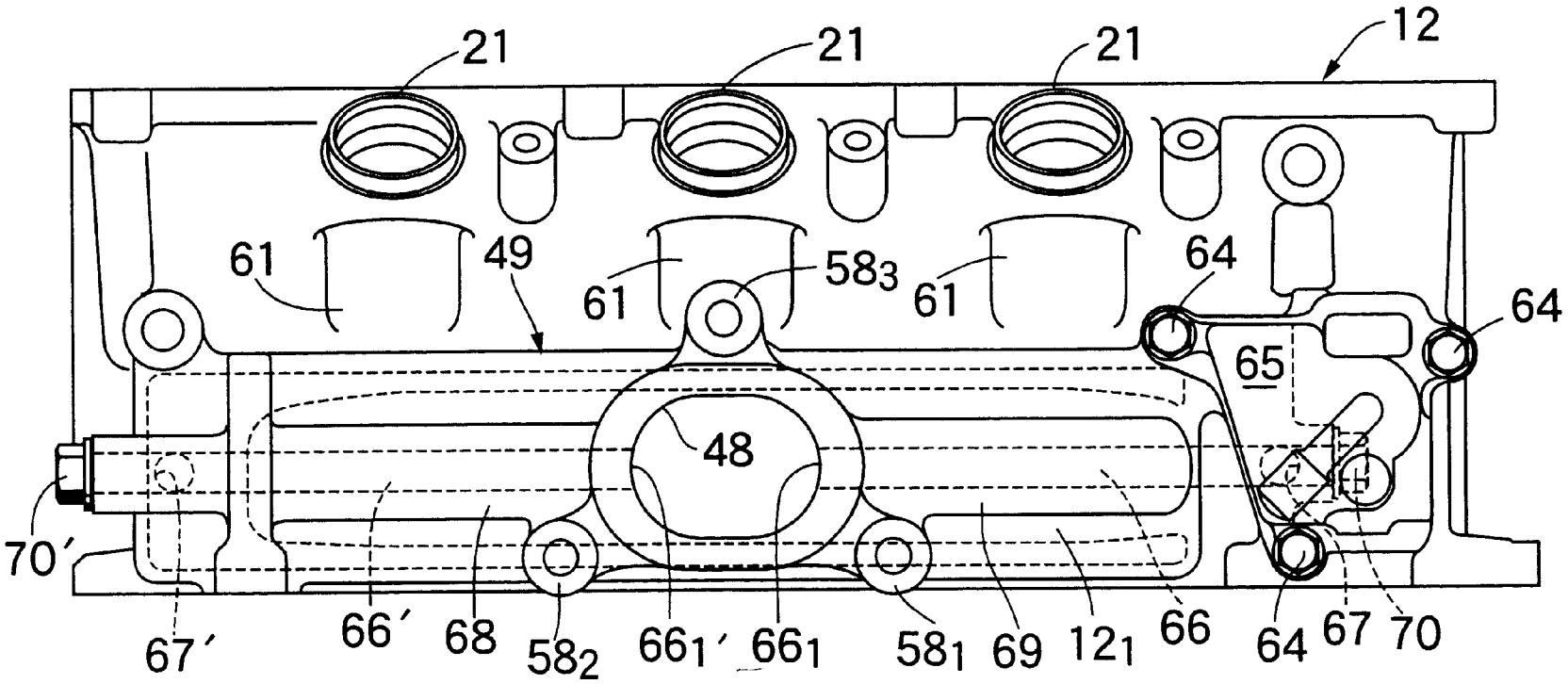

A sixth embodiment of the present invention will be described below with reference to FIGS. 13 and 14.

In the sixth embodiment, a first exhaust secondary air passage 66 and a second exhaust secondary air passage 67 are defined in the cylinder head 12. Two ribs 68 and 69 are formed in the arch-shaped side wall $12_1$ of the protrusion 49 of the cylinder head 12 to extend lengthwise of the cylinder head 12 with the exhaust outlet 48 interposed therebetween, and the first exhaust secondary air passage 66 is defined within one of the ribs 69. The first exhaust secondary air passage 66 is defined to extend along the side wall $12_1$ of the arch-shaped protrusion 49 and hence, an increase in size of the cylinder head 12 and an increase in vibration can be inhibited.

An outlet $66_1$ (an air introduction opening for introducing exhaust secondary air into an exhaust system) is provided at one end of the first exhaust secondary air passage 66, and opens in the vicinity of the exhaust outlet 48 of the exhaust collecting section 47, and the other end of the first exhaust secondary air passage 66 opens into an end surface of the cylinder head 12 and is occluded by a plug 70. One end of the second exhaust secondary air passage 67 defined along the end surface of the cylinder head 12 opens in the vicinity of the other end of the first exhaust secondary air passage 66, and the other end of the passage 67 opens into the side wall $12_2$ of the cylinder head 12 on the intake side. Exhaust secondary air introduced from an air cleaner 72 by an air pump 71 is supplied via a control valve 73 to the second exhaust secondary air passage 67 which opens into the side wall $12_2$ of the cylinder head 12 on the intake side. The air pump 71 and the control valve 73 are connected to and controlled by an electronic control unit U. When the exhaust emission control catalyst is inactive, immediately after operation of the engine E, the operations of the air pump 71 and the control valve 73 are controlled by a command from the electronic control unit U, and the exhaust secondary air supplied to the second exhaust secondary air passage 67 is supplied via the first exhaust secondary air passage 66 to the exhaust collecting section 47 of the collecting exhaust port 18. Thus, harmful components such as HC and CO in the exhaust gas can be converted into harmless components by reburning, and moreover, the exhaust emission control catalyst can be activated early, thereby providing a satisfactory exhaust gas purifying effect.

In this way, the outlet 66, of the first exhaust secondary air passage 66 opens into the exhaust collecting section 47 which is difficult to be influenced by the inertia and pulsation of the exhaust gas, because the plurality of exhaust ports 46 are collected therein. Therefore, the influence of the inertia and pulsation of the exhaust gas can be eliminated, and the exhaust secondary air can be supplied stably without complication of the structures of the passages for supplying the exhaust secondary air. In addition, since the first and second exhaust secondary air passages 66 and 67 are integrally defined in the cylinder head 12, the space and the number of parts can be reduced, as compared with the case where exhaust secondary air passages are defined by separate members outside the cylinder head 12. Further, since the two ribs 68 and 69 project from the side wall $12_1$ of the protrusion 49, the rigidity of the protrusion 49 can be increased by the ribs 68 and 69, whereby the vibration can be reduced. Particularly, the two ribs 68 and 69 connect the end of the cylinder head 12 to the boss portions $58_1$ and $58_2$ for mounting the exhaust pipe 19, which contributes to the increase in rigidity of mounting of the exhaust pipe 19. Particularly, one of the ribs 69 is connected to a tensioner mounting seat 63 for supporting a chain tensioner 65, whereby the rigidity of mounting of the exhaust pipe 19 and the rigidity of mounting of the chain tensioner 65 are effectively increased.

Further, in the sixth embodiment, EGR passages are defined by utilizing the protrusion 49 of the cylinder head 12. An EGR gas supply system includes a first EGR gas passage 66' and a second EGR gas passage 67'. The first EGR gas passage 66' is defined within the other rib 68 of the protrusion 49 of the cylinder head 12. An inlet $\mathbf{66_1}$' at one end of the first EGR gas passage 66' opens in the vicinity of the exhaust outlet 48 of the exhaust collecting section 47, and the other end of the first EGR gas passage 66' opens into the end surface of the cylinder head 12 and is occluded by a plug 70'. One end of the second EGR gas passage 67' defined along the end surface of the cylinder head 12 opens in the vicinity of the other end of the first EGR gas passage 66', and the other end of the passage 67' opens into the side wall $\mathbf{12_2}$ of the cylinder head 12 on the intake side. The second EGR gas passage 67' opening into the side wall $\mathbf{12_2}$ of the cylinder head 12 on the intake side is connected to the three intake ports 17 through an EGR valve 74 for controlling the flow rate of an EGR gas.

Thus, an exhaust gas removed from the collecting exhaust port 18 is recirculated to the intake system through the first and second EGR gas passages 66' and 67' and the EGR valve 74, whereby the generation of NOx by combustion can be inhibited, and NOx in the exhaust gas can be reduced.

In this way, the inlet $\mathbf{66_1}$' of the first EGR gas passage 66' opens into the exhaust collecting section 47 which is difficult to be influenced by the inertia and pulsation of the exhaust gas, because the plurality of exhaust ports 46 are collected therein. Therefore, the influence of the inertia and pulsation of the exhaust gas can be eliminated, and the EGR gas can be stably supplied. In addition, since the first and second EGR gas passages 66' and 67' are integrally defined in the cylinder head 12, the space and the number of parts can be reduced, as compared with the case where EGR gas passages are defined by separate members outside the cylinder head 12.

Figure 15:
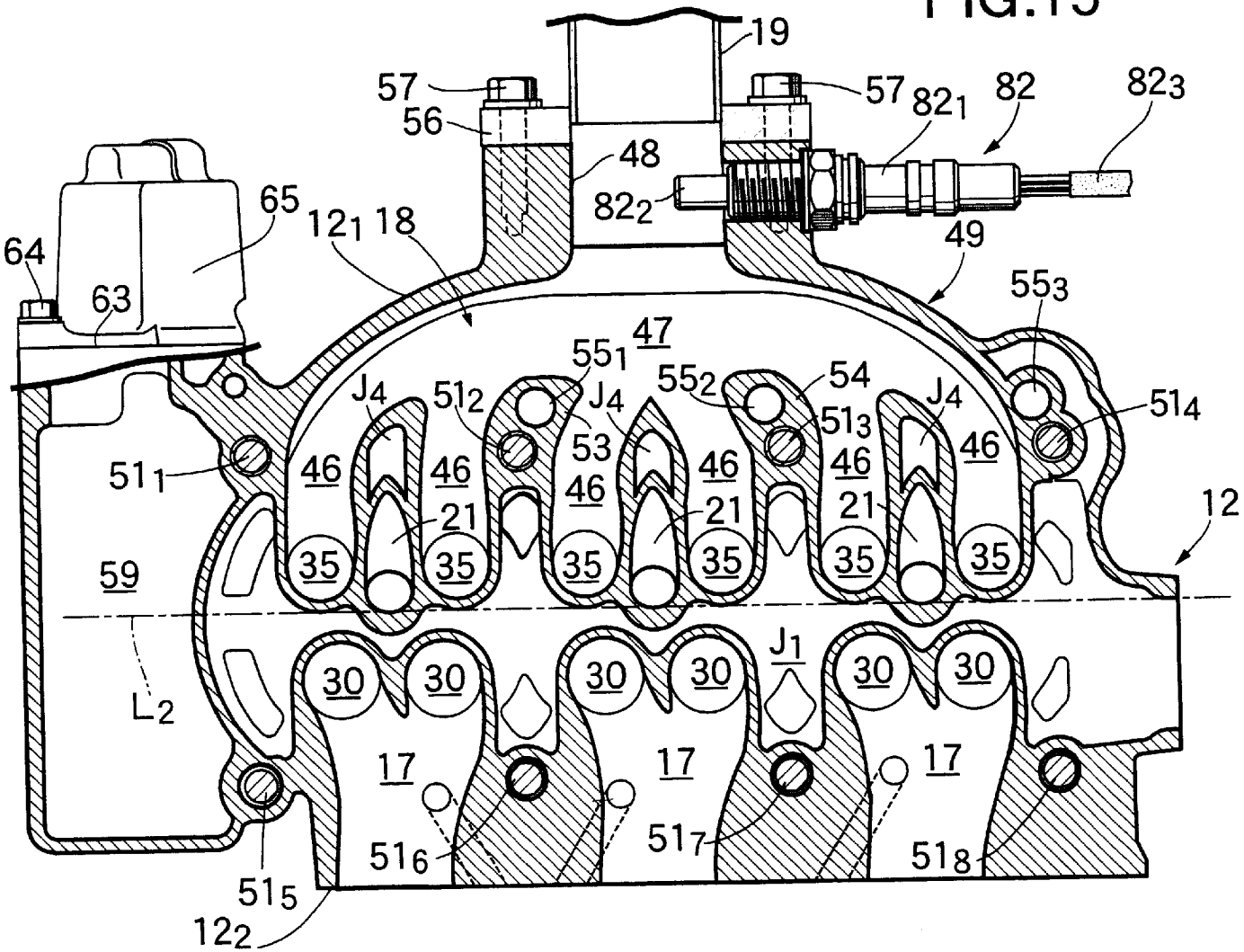
FIG. 15 is a view similar to FIG. 2, but according to a seventh embodiment of the present invention.

A seventh embodiment of the present invention will be described below with reference to FIG. 15.

In the seventh embodiment, an oxygen concentration sensor 82 for detecting a concentration of oxygen in an exhaust gas is mounted in the vicinity of an exhaust outlet 48 defined at an outer end of the protrusion 49 of the cylinder head 12. The oxygen concentration sensor 82 includes a body portion $\mathbf{82_1}$ fixed in the vicinity of the exhaust outlet 48 of the protrusion 49, a detecting portion $\mathbf{82_2}$ provided at a tip end of the body portion $\mathbf{82_1}$ to face the exhaust collecting section 47, and a harness $\mathbf{82_3}$ extending from a rear end of the body portion $\mathbf{82_1}$. The body portion $\mathbf{82_1}$ is disposed parallel to the cylinder array line $L_2$, so that it is opposed to the side wall $\mathbf{12_1}$ of the protrusion 49.

In this way, the detecting portion $\mathbf{82_2}$ of the oxygen concentration sensor 82 faces the exhaust collecting section 47 where exhaust gasses from the three combustion chambers 16 are collected. Therefore, a concentration of oxygen in an exhaust gas in the entire engine E can be detected by the single oxygen concentration sensor 82, and the number of the oxygen concentration sensors 82 can be maintained to the minimum. Moreover, by provision of the oxygen concentration sensor 82 in the exhaust collecting section 47 of the cylinder head 12, the oxygen concentration sensor 82 can be early raised in temperature for activation by heat of the exhaust gas having a high temperature immediately after leaving the combustion chambers 16.

In addition, since the protrusion 49 is formed into the arch shape, dead spaces are defined on opposite sides of the protrusion 49 in the direction of the cylinder array line $L_2$. However, since the oxygen concentration sensor 82 is mounted in the vicinity of the outer end of the arch-shaped protrusion 49 with the body portion $\mathbf{82_1}$ provided in an opposed relation to and along the side wall $\mathbf{12_1}$ of the protrusion 49, the oxygen concentration sensor 82 can be disposed compactly by effectively utilizing one of the dead spaces. Moreover, the body portion $\mathbf{82_1}$ of the oxygen concentration sensor 82 is gradually more and more spaced apart from the side wall $\mathbf{12_1}$ of the protrusion 49. Therefore, the distance of the harness $\mathbf{82_3}$ extending from the body portion $\mathbf{82_1}$ from the protrusion 49 can be ensured sufficiently, thereby alleviating the thermal influence received by the harness $\mathbf{82_3}$.

Further, the oxygen concentration sensor 82 is disposed on the opposite side from the cam driving chain chamber 59 where the other member such as the chain tensioner 65 is mounted. Therefore, it is possible to prevent the interference of the oxygen concentration sensor 82 with the other member such as the chain tensioner 65 during the attachment and detachment of the oxygen concentration sensor 82, leading to an enhanced workability, and moreover, the oxygen concentration sensor 82 and the other member can be disposed compactly in a distributed manner on opposite sides in the direction of the cylinder array line $L_2$.

Figure 16:
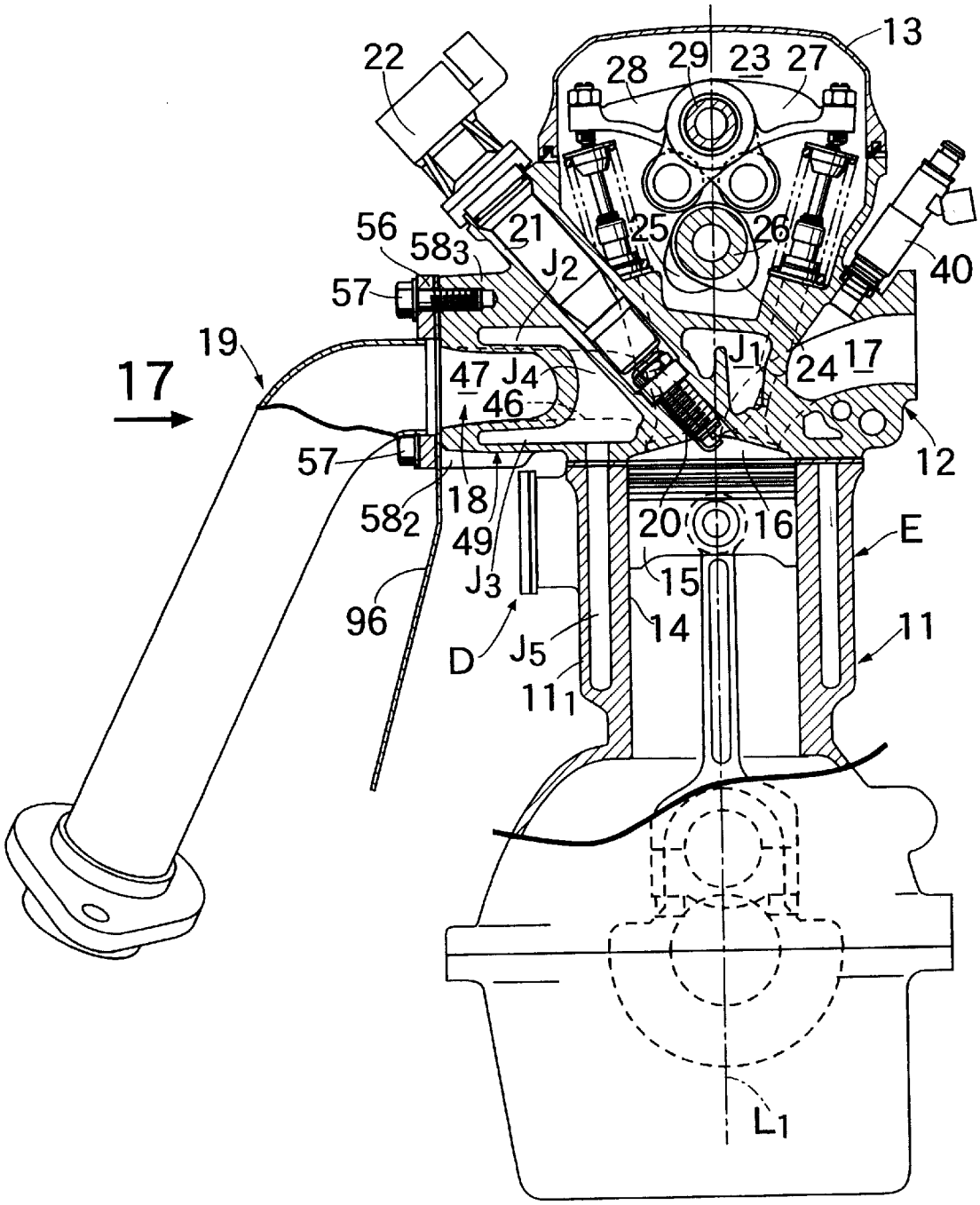

An eighth embodiment of the present invention will be described below with reference to FIGS. 16 to 18.

In the eighth embodiment, two vibration absorbing means D are mounted in the side wall $\mathbf{11_1}$ of the cylinder block 11 on the exhaust side. A through-bore $\mathbf{11_3}$ defined in the side wall $\mathbf{11_1}$ of the cylinder block 11 to mount each of the vibration absorbing means D has an inner end which opens into a water jacket $J_5$ defined in the cylinder block 11, and an outer end which opens into an outer surface of the side wall $\mathbf{11_1}$ of the cylinder block 11. A housing 92 having an external threaded portion formed in its outer peripheral surface is screwed into internal threaded portion formed in an inner peripheral surface of the through-bore $\mathbf{11_3}$ from the outer surface of the side wall $\mathbf{11_1}$, and is fixed to the inner peripheral surface of the through-bore $\mathbf{11_3}$ with a seal member 93 interposed between the housing 92 and the cylinder block 11. An elastic membrane 94 is affixed to an opening at a tip end of the housing 92 of which inside is hollow, and a closed space 95 is defined between the elastic membrane 94 and the housing 92. In a state in which the housing 92 has been mounted in the through-bore $\mathbf{11_3}$, the elastic membrane 94 faces the water jacket $J_5$.

The elastic membrane 94 is formed from a rubber or a synthetic resin reinforced with a fabric, a synthetic fiber or a glass fiber and is fixed in the opening in the housing 92, for example, by baking. In a state in which the vibration absorbing means D has been mounted in the through-bore $\mathbf{11_3}$ in the side wall $\mathbf{11_1}$ of the cylinder block 11, the elastic membrane 94 is disposed substantially flush with the wall surface of the water jacket $J_5$ so as not to protrude in the water jacket $J_5$.

When the pistons 15 vertically moved during operation of the engine E collides with inner walls of the cylinders 14, respectively, and the vibrations of the pistons are transmitted from the cylinders 14 to cooling water within the water jacket $J_5$, a large variation in pressure is generated in the cooling water which is non-compressible fluid, whereby the side $wall_1$ of the cylinder block 11 may be vibrated and for this reason, a piston-slapping sound causing a noise may be radiated to the outside from the cylinder block 11. In the engine E provided with the vibration absorbing means D in the present embodiment, however, the elastic membranes 94 of the vibration absorbing means D are resiliently deformed with the variation in pressure of the cooling water within the water jacket $J_5$, whereby the variation in pressure of the cooling water is absorbed. As a result, a vibrating force transmitted from the cooling water to the side wall $\mathbf{11}_1$ of the cylinder block 11 is reduced to weaken the vibration of the side wall $\mathbf{11}_1$ and hence, the piston-slapping sound radiated to the outside from the cylinder block 11 is reduced. Moreover, the outer surface of the elastic membrane 94 facing the space 95 is covered with the housing 92 and hence, a noise caused by the vibration of the elastic membrane 94 cannot be radiated directly to the outside.

Figure 17:
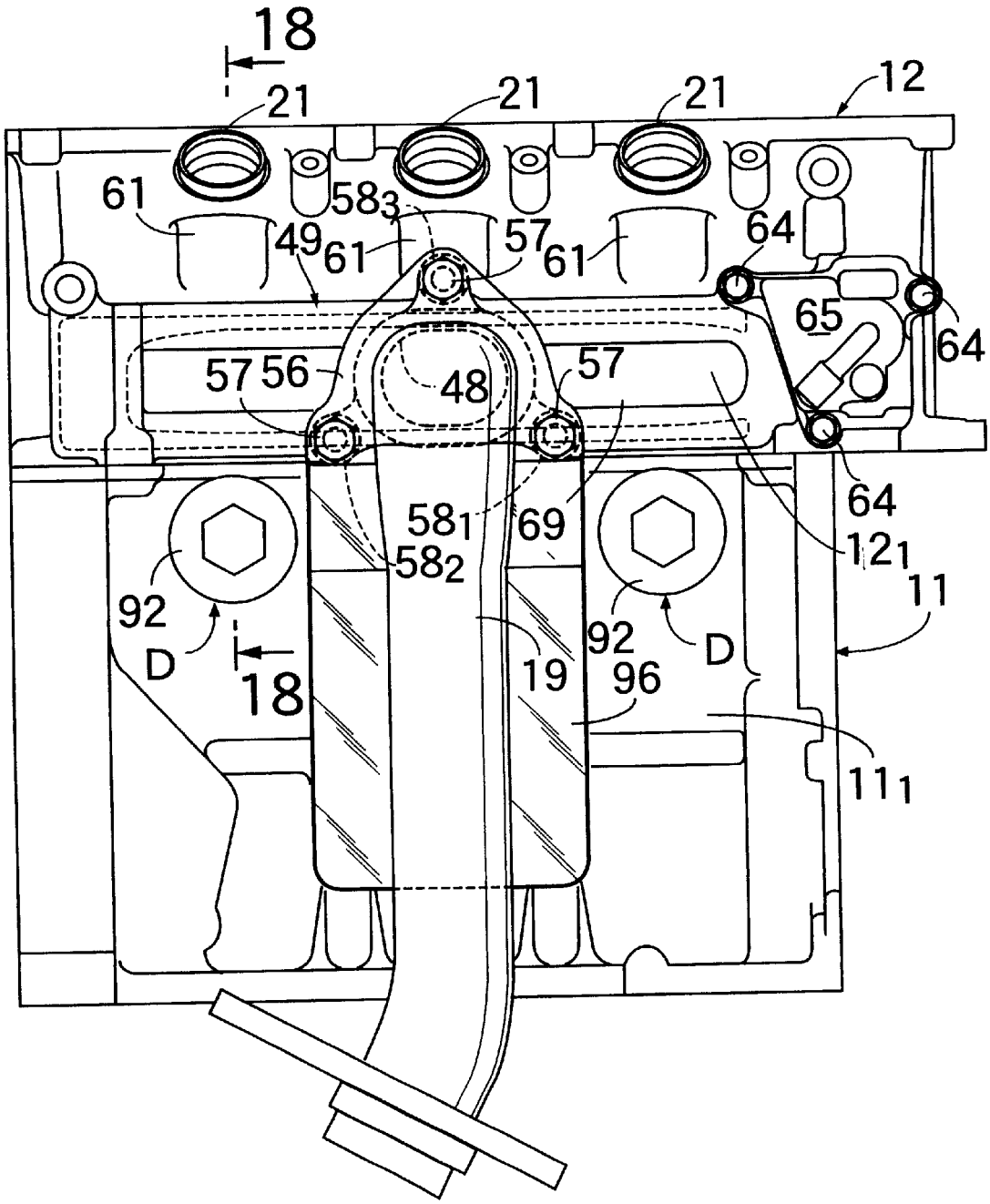
Figure 18:
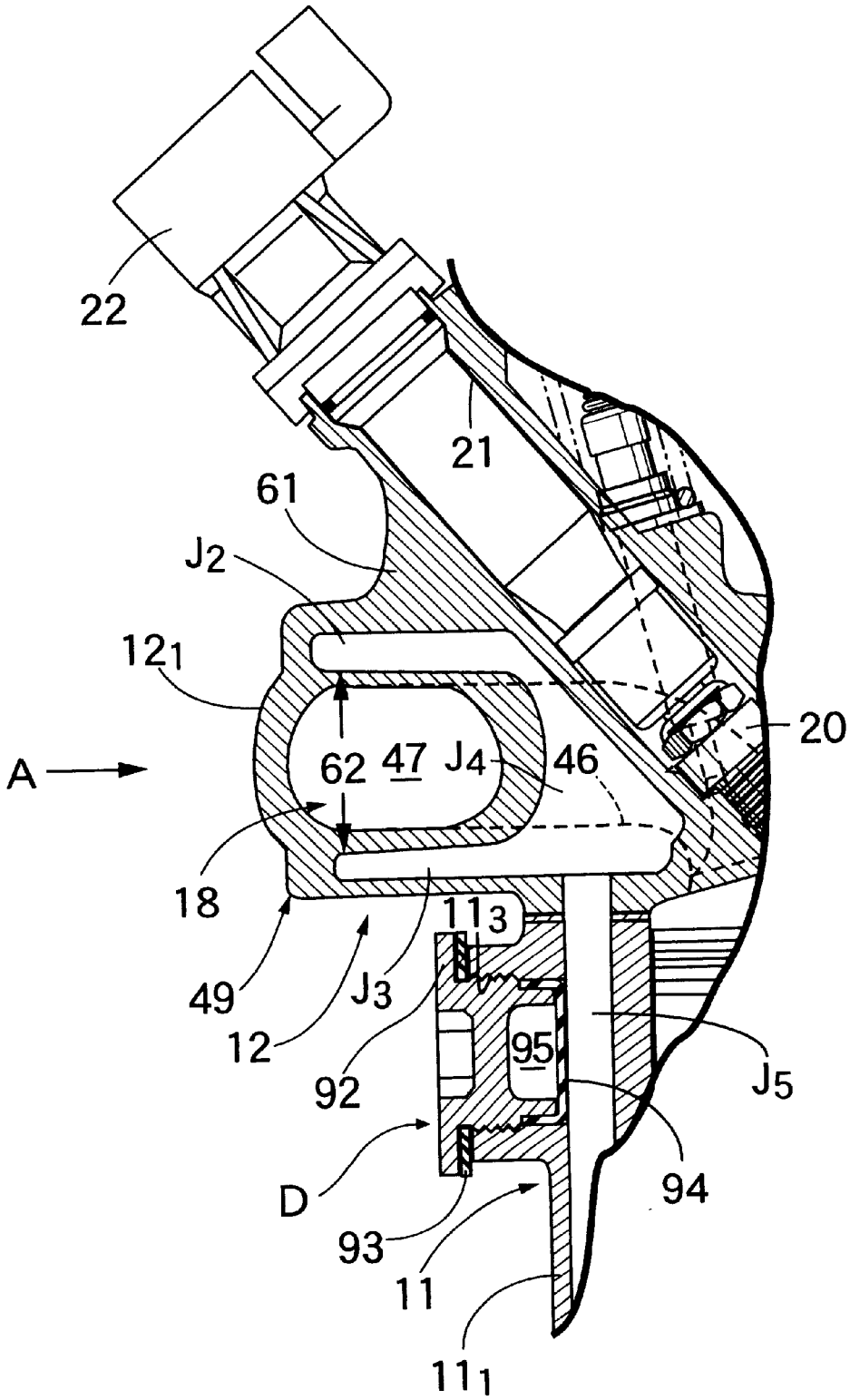

As best shown in FIG. 17, the two vibration absorbing means D are disposed at locations on left and right sides of and deviated from the exhaust pipe 19, as the side wall $\mathbf{11}_1$ of the cylinder block 11 on the exhaust side is viewed from the front. In other words, when the exhaust pipe 19 is projected onto the side wall $\mathbf{11}_1$ of the cylinder block 11 on the exhaust side, the two vibration absorbing means D are disposed out of a region of such projection. The above-described arrangement ensures that the heat of the exhaust pipe 19 heated to a high temperature is difficult to be transferred to the vibration absorbing means D, whereby the degradation in durability of the elastic membrane 94 easily affected by the heat can be prevented. Moreover, the heat transferred to the vibration absorbing means D can be further diminished by the disposition of a heat insulting plate 96 between the exhaust pipe 19 and the cylinder block 11.

It is desirable that the vibration absorbing means D are disposed at locations close to top dead centers of the pistons 15, namely, at locations close to the cylinder head 12 in order to enhance the noise preventing effect. If the vibration absorbing means D are disposed in proximity to the cylinder head 12, they are liable to interfere with the exhaust pipe 19. According to the present embodiment, however, the disposition of the vibration absorbing means D out of the region of projection of the exhaust pipe 19 ensures that even if the exhaust pipe 19 is disposed in proximity to the cylinder block 11, the exhaust pipe 19 cannot interfere with the vibration absorbing means D. Therefore, the exhaust pipe 19 can be disposed in sufficient proximity to the cylinder block 11, whereby the engine E can be made compact.

Figure 19:
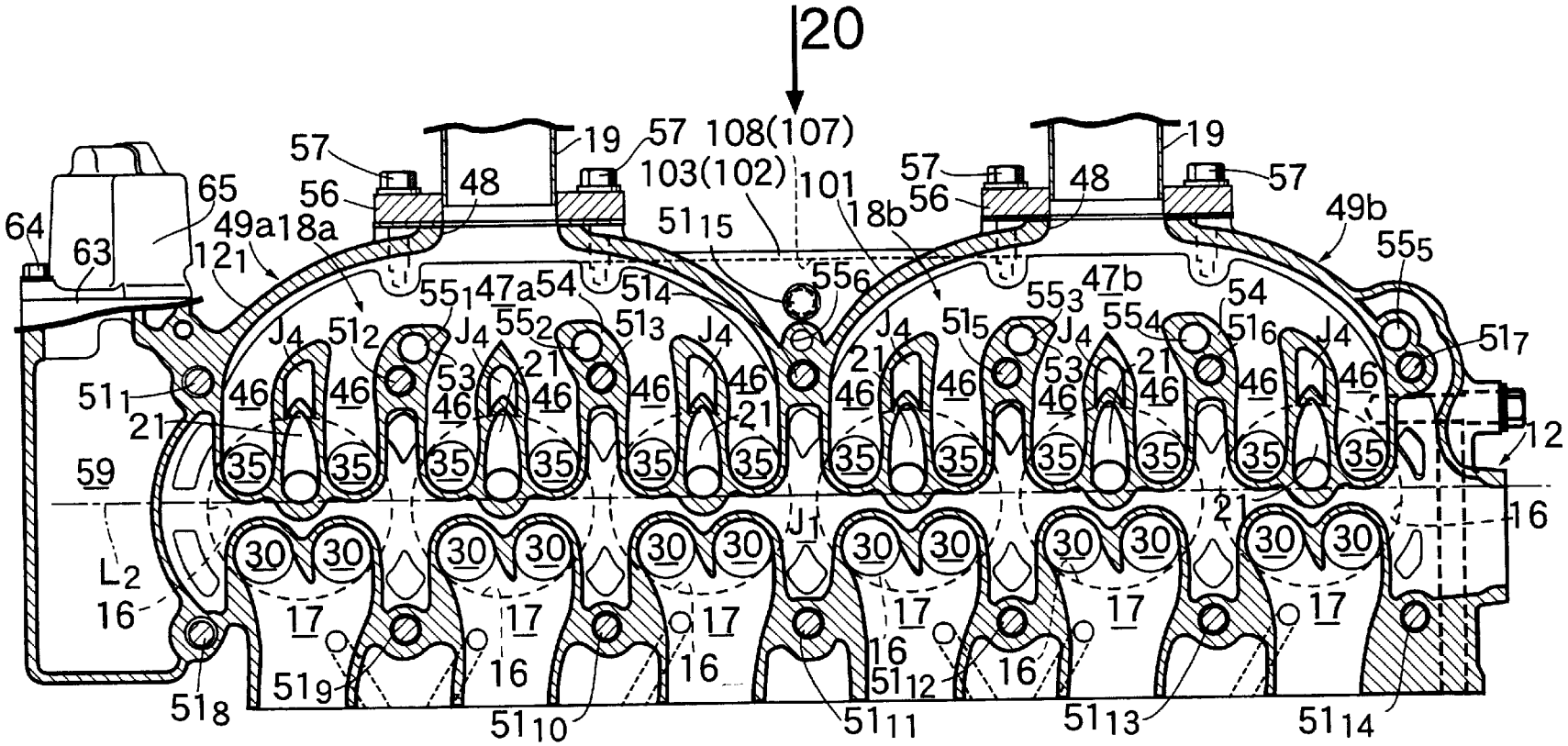
FIGS. 19 and 20 show a ninth embodiment of the present invention, FIG. 19 being a view similar to FIG. 2, and FIG. 20 being a view taken in the direction of an arrow 20 in FIG. 19.
Figure 20:
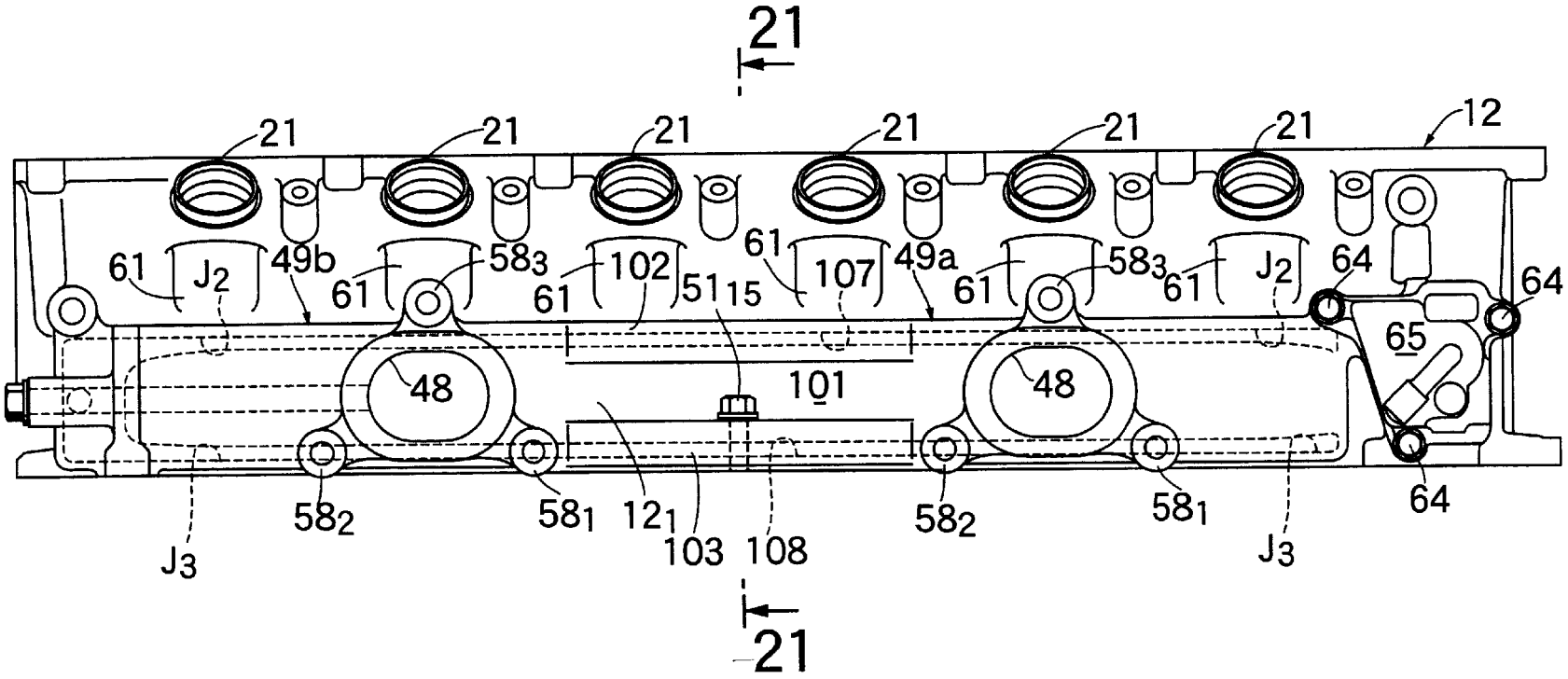
Figure 21:
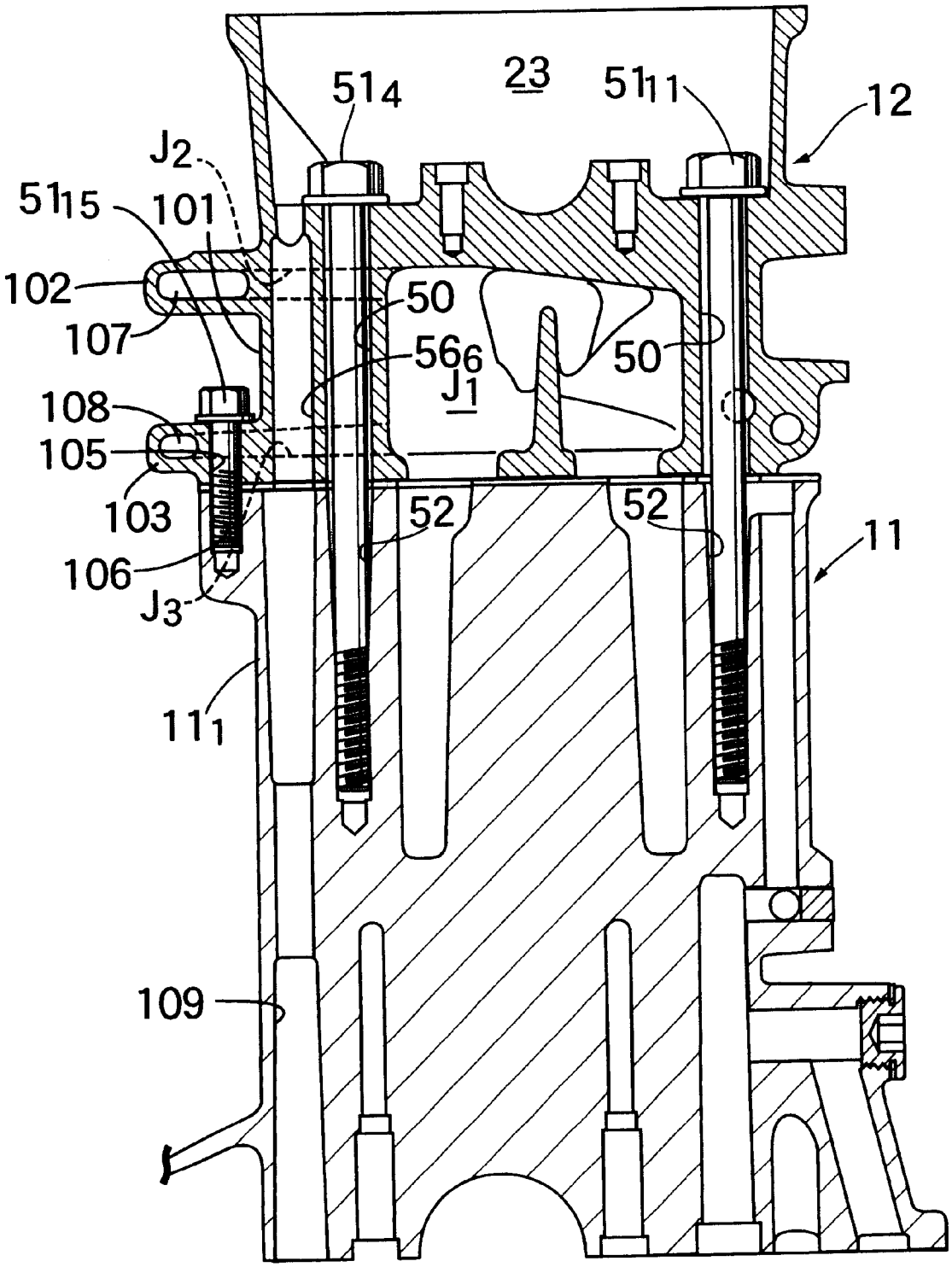
FIG. 21 is a sectional view taken along a line 21—21 in FIG. 20.

A ninth embodiment of the present invention will be described below with reference to FIGS. 19 to 21.

The engine E in the ninth embodiment is a serial or in-line type 6-cylinder engine, wherein each of the six intake ports 17 extending from the six combustion chambers 16 is formed into a Y-shape. The six intake ports 17 open independently into a side surface of the cylinder head 12 on the intake side without being collected together. On the other hand, each of first and second collecting exhaust ports 18*a* and 18*b* is comprised of a total of six exhaust ports 46 extending from the three combustion chambers 16, respectively, and an arch-shaped first/second exhaust collecting section 47*a*, 47*b* where the six exhaust ports 46 are integrally collected together. Exhaust outlets 48, to which the exhaust pipes 19 are coupled, are defined in central portions of the first and second exhaust collecting section 47*a* and 47*b*.

When the six cylinders 14 are called #1, #2, #3, #4, #5 and #6 in sequence from the side of the cam driving chain chamber 59, the first collecting exhaust port 18*a* permits exhaust gases from the combustion chambers 16 in the three #4, #5 and #6 cylinders on one end side of a cylinder array line $L_2$ to be collected in the first exhaust collecting section 47*a*, and the second collecting exhaust port 18*b* permits exhaust gases from the combustion chambers 16 in the three #1, #2 and #3 cylinders on the other end side of the cylinder array line $L_2$ to be collected in the second exhaust collecting section 47*b*. The first and second collecting exhaust ports 18*a* and 18*b* have substantially the same structure. By dividing the collecting exhaust port into the first and second collecting exhaust ports 18*a* and 18*b* having the same structure, cores for forming the collecting exhaust ports during the casting production of the cylinder head 12 can be reduced in size, and moreover, one type of the cores can be used to contribute to a reduction in cost.

The order of ignition of the #1, #2, #3, #4, #5 and #6 cylinders is #1→#5→#3→#6→#2→#4. Thus, the order of ignition of the three #1, #2 and #3 cylinders corresponding to the first collecting exhaust port 18*a* is not continuous, and the order of ignition of the three #4, #5 and #6 cylinders corresponding to the second collecting exhaust port 18*b* is not continuous either. Therefore, an exhaust interference among the three #1, #2 and #3 cylinders corresponding to the first collecting exhaust port 18*a* is not generated, and an exhaust interference among the three #4, #5 and #6 cylinders corresponding to the second collecting exhaust port 18*b* is not generated either.

Two portions of the exhaust-side side wall $\mathbf{12}_1$ of the cylinder head 12 which are faced by the first and second exhaust collecting sections 47*a* and 47*b* are curved in an arch shape to protrude outwards, thereby forming first and second protrusions 49*a* and 49*b* projecting from the side wall $\mathbf{11}_1$ of the cylinder block 11. Therefore, the first and second exhaust collecting sections 47*a* and 47*b* of the first and second collecting exhaust ports 18*a* and 18*b* defined in the first and second protrusions 49*a* and 49*b* directly face the side walls $\mathbf{12}_1$ of the arch-shaped first and second protrusions 49*a* and 49*b* with no water jacket interposed therebetween.

Since the first and second exhaust collecting sections 47*a* and 47*b* of the first and second collecting exhaust ports 18*a* and 18*b* defined in the first and second protrusions 49*a* and 49*b* directly face the side walls $\mathbf{12}_1$ of the first and second protrusions 49*a* and 49*b* with no water jacket interposed therebetween, as just described above, the cylinder head 12 can be made compact, and it is easy to form the cylinder head 12, as compared with the case where a water jacket is interposed between the first and second exhaust collecting sections 47*a* and 47*b* and the side walls $\mathbf{12}_1$. Moreover, since the side wall $\mathbf{12}_1$ is formed into the arch shape, the width of lengthwise opposite ends of the cylinder head 12 is decreased. This enables the further compactness, and can also contribute to an increase in rigidity of the cylinder head 12, and further, the flowing of an exhaust gas can be smoothened. Moreover, a recess 101 (see FIG. 19) is defined between the first and second protrusions 49*a* and 49*b* and hence, it is possible to provide a reduction in size of the engine E by effectively utilizing a space in the recess 101.

Seven bolts bores 50 are defined in the cylinder head 12 on the intake and exhaust sides, respectively. Thus, the cylinder head 12 is fastened to the cylinder block 11 by screwing fourteen cylinder head fastening bolts $\mathbf{51}_1$, $\mathbf{51}_2$, $\mathbf{51}_3$, $\mathbf{51}_4$, $\mathbf{51}_5$, $\mathbf{51}_6$, $\mathbf{51}_7$, $\mathbf{51}_8$, $\mathbf{51}_9$, $\mathbf{51}_{10}$, $\mathbf{51}_{11}$, $\mathbf{51}_{12}$, $\mathbf{51}_{13}$ and $\mathbf{51}_{14}$ inserted from above in a total of fourteen bolt bores 50 into the bolt bores 52 defined in the cylinder block 11.

The two wall portions 53 and 54 extend within the first collecting exhaust port 18*a* to partition the three cylinders 14 corresponding to the first collecting exhaust port 18*a* from one another. The two cylinder head fastening bolts $\mathbf{51}_2$ and $\mathbf{51}_3$ are passed through the two wall portions 53 and 54. The oil return passages $\mathbf{55}_1$ and $\mathbf{55}_2$ as oil passages are provided to extend through tip end areas of the two wall portions 53 and 54, i.e., areas of the two wall portions 53 and 54 on the side of the first exhaust collecting section 47*a* from the two cylinder head fastening bolts $\mathbf{51}_2$ and $\mathbf{51}_3$, respectively. Likewise, the two wall portions 53 and 54 extend within the second collecting exhaust port 18*b* to partition the three cylinders 14 corresponding to the second collecting exhaust port 18*b* from one another. The two cylinder head fastening bolts $\mathbf{51}_5$ and $\mathbf{51}_6$ are passed through the two wall portions 53 and 54, respectively. The oil return passages $\mathbf{55}_3$ and $\mathbf{55}_4$ as oil passages are provided to extend through tip end areas of the two wall portions 53 and 54, i.e., areas of the two wall portions 53 and 54 on the side of the second exhaust collecting section 47*b* from the two cylinder head fastening bolts $\mathbf{51}_5$ and $\mathbf{51}_6$, respectively.

In the first collecting exhaust port 18*a*, the two wall portions 53 and 54 are curved, so that they extend in the direction of flowing of an exhaust gas within the first collecting exhaust port 18*a*, i.e., so that they are directed to the exhaust outlet 48 located centrally. Therefore, the two oil return passages $\mathbf{55}_1$ and $\mathbf{55}_2$ are offset toward the exhaust outlet 48 with respect to the two adjacent cylinder head fastening bolts $\mathbf{51}_2$ and $\mathbf{51}_3$. The above-described arrangement of the oil return passages $\mathbf{55}_1$ and $\mathbf{55}_2$ and the cylinder head fastening bolts $\mathbf{51}_2$ and $\mathbf{51}_3$ ensures that an exhaust gas can flow smoothly within the first collecting exhaust port 18*a*, whereby the exhaust resistance can be reduced, while avoiding an increase in size of the cylinder head 12. The second collecting exhaust port 18*b* has the same structure as the above-described structure of the first collecting exhaust port 18*a*.

The recess 101 is defined between the first and second protrusions 49*a* and 49*b* formed into the arch shape and has such a shape that it extends along the first and second collecting exhaust ports 18*a* and 18*b*. The first and second protrusions 49*a* and 49*b* are connected to each other by a pair of upper and lower connecting walls 102 and 103 which are disposed above and below the recess 101. A fifteenth cylinder head fastening bolt $\mathbf{51}_{15}$ for fastening the cylinder head 12 to the cylinder block 11 is supported at its head on an upper surface of the lower connecting wall 103. The above-described arrangement ensures that a portion fastening between the cylinder head 12 and cylinder block 11 by the fifteenth cylinder head fastening bolt $\mathbf{51}_{15}$ can be made compact and moreover, the cross section of a flow path in a communication passage 107 (which will be described hereinafter) in the upper connecting wall 102 can be increased.

A sixth oil return passage $\mathbf{55}_6$ as an oil passage is defined between the two cylinder head fastening bolts $\mathbf{51}_4$ and $\mathbf{51}_{15}$ and, communicates with the oil pan through an oil return passage 109 defined in the cylinder block 11. In this way, the oil return passage $\mathbf{55}_6$ is defined at a location between the first and second protrusions 49*a* and 49*b*. Therefore, an increase in size of the cylinder head 12 is avoided, and moreover, a portion defining the oil return passage $\mathbf{55}_6$ can be allowed to function as a wall connecting the first and second protrusions 49*a* and 49*b*, thereby increasing the rigidity of the cylinder head 12 to alleviate the vibration of the first and second protrusions 49*a* and 49*b*. Further, the vicinity of the oil return passage $\mathbf{55}_6$ can be heated by the heat from the first and second collecting exhaust ports 18*a* and 18*b* in the first and second protrusions 49*a* and 49*b* without providing a special oil heater, thereby reducing the viscosity of an oil to decrease the friction resistance of each of various sliding portions.

Since the first and second protrusions 49*a* and 49*b* are connected to each other by the connecting walls 102 and 103, as described above, the first and second protrusions 49*a* and 49*b* can be reinforced by each other, whereby the rigidity thereof can be increased, and the generation of the vibration can be inhibited. Additionally, the thermal strain of the first and second protrusions 49*a* and 49*b* having the first and second collecting exhaust ports 18*a* and 18*b* which are defined therein and through which a high-temperature exhaust gas flows can be maintained to the minimum. Moreover, since the cylinder head 12 is fastened to the cylinder block 11 between the first and second protrusions 49*a* and 49*b* by the cylinder head fastening bolt $\mathbf{51}_{15}$, the rigidity of the first and second protrusions 49*a* and 49*b* can be increased, thereby further effectively preventing the generation of the vibration, and moreover, enhancing the sealability between the cylinder head 12 and the cylinder block 11.

Communication passages 107 and 108, through which cooling water flows, are defined in the upper and lower connecting walls 102 and 103, respectively. Thus, the upper water jackets $J_2$ in the first and second protrusions 49*a* and 49*b* communicate with each other through the communication passage 107 in the upper connecting wall 102, while the lower water jackets $J_3$ in the first and second protrusions 49*a* and 49*b* communicate with each other through the communication passage 108 in the lower connecting wall 103. Since adjacent ones of the upper water jackets $J_2$ in the first and second protrusions 49*a* and 49*b* communicate with each other through the communication passage 107 in the upper connecting wall 102, and adjacent ones of the lower water jackets $J_3$ communicate with each other through the communication passage 108 in the lower connecting wall 103, as just described above, the flowing of the cooling water within the water jackets $J_2$ and $J_3$ in the first and second protrusions 49*a* and 49*b* can be smoothened to prevent the generation of a stagnation, thereby enhancing the cooling effect.

Figure 22:
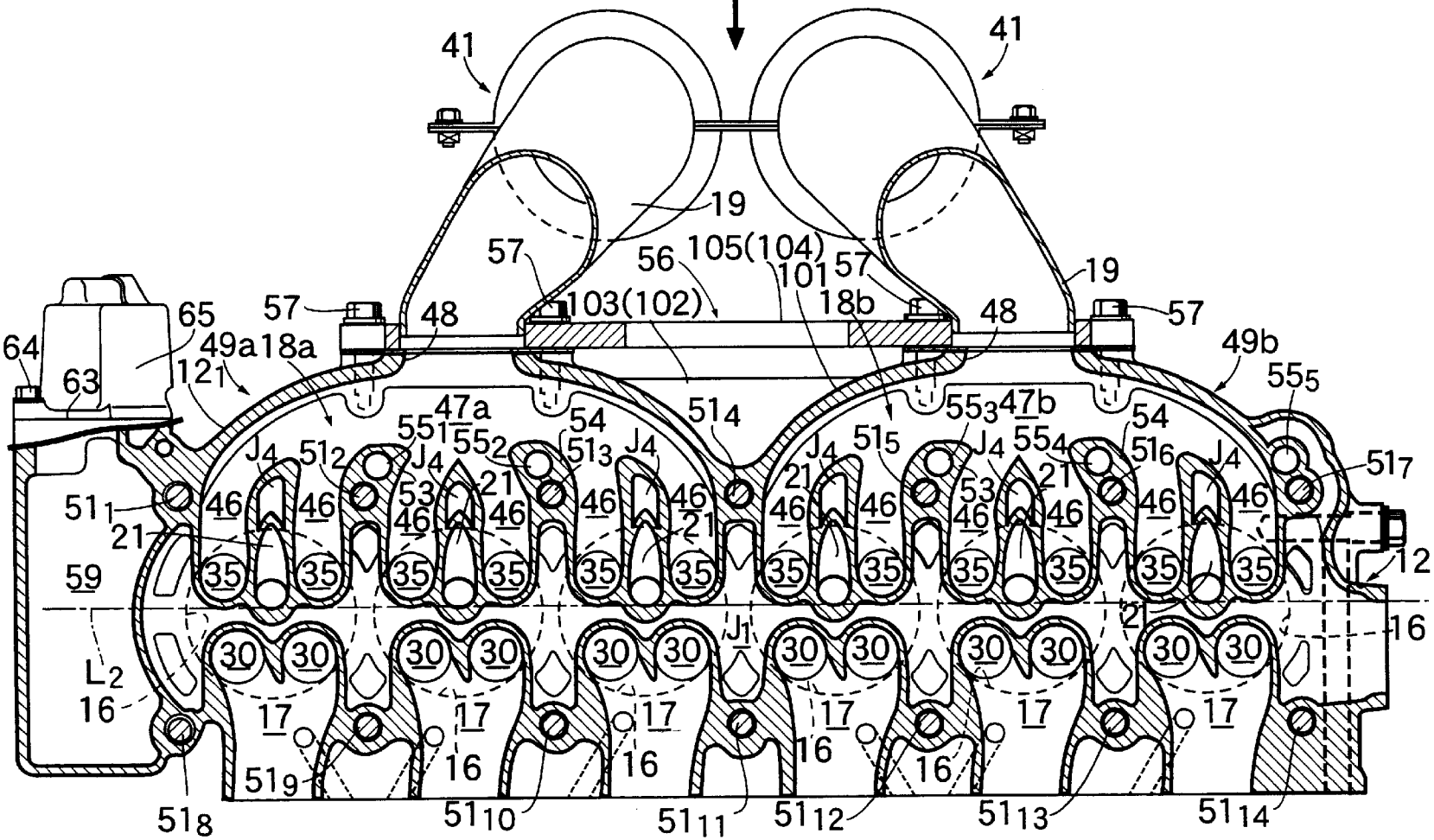
FIGS. 22 and 23 show a tenth embodiment of the present invention, FIG. 22 being a view similar to FIG. 2, and FIG. 23 being a view taken in the direction of an arrow 23 in FIG. 22.
Figure 23:
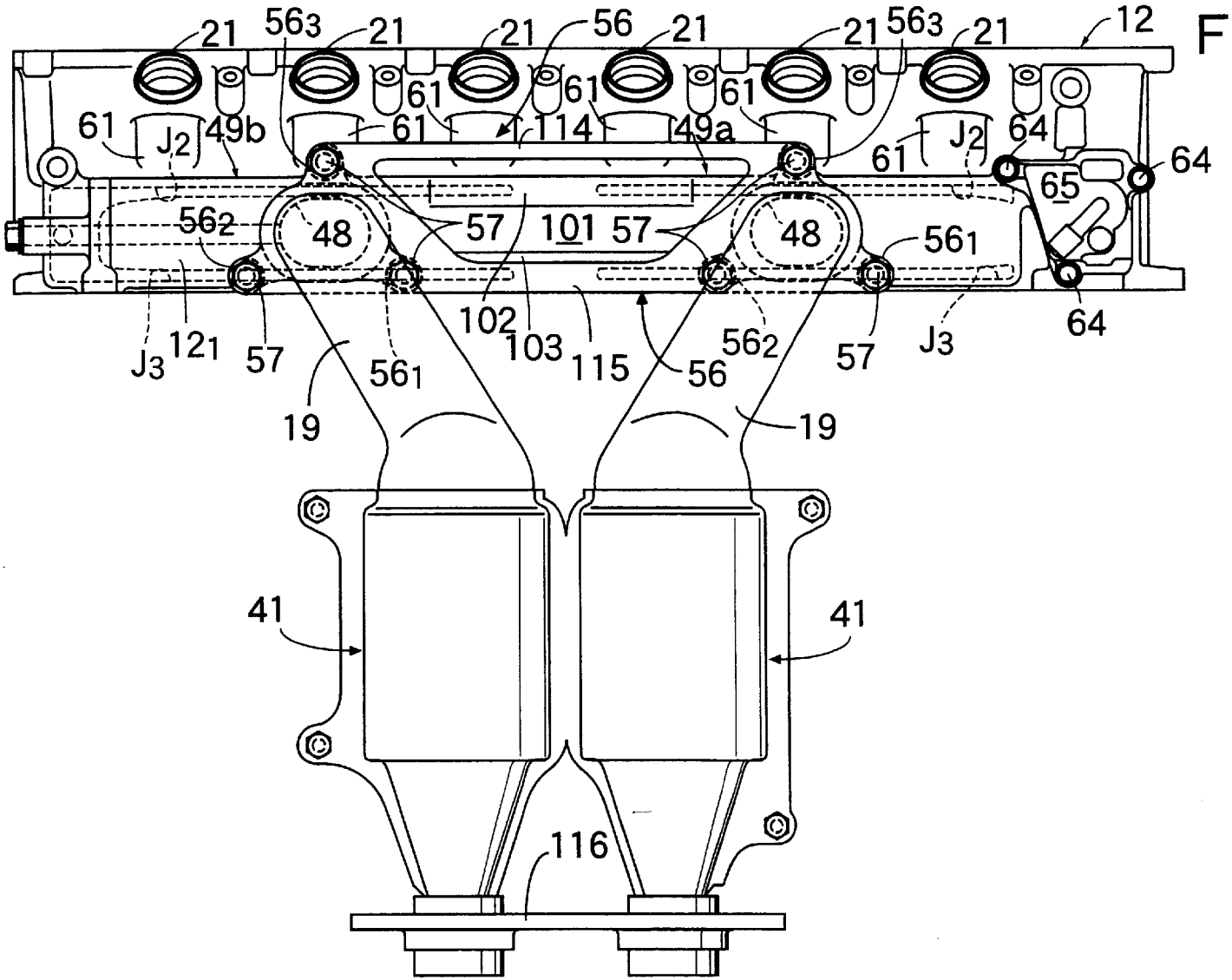

A tenth embodiment of the present invention will be described below with reference to FIGS. 22 and 23.

The basic structure of the engine E in the tenth embodiment is identical to that of a serial or in-line type 6-cylinder engine similar to that in the ninth embodiment. Two exhaust pipes 19 coupled to exhaust outlets 48 of the first and second collecting exhaust ports 18*a* and 18*b* in the first and second protrusions 49*a* and 49*b* are integrally connected at their upstream portions to each other by the common mounting flange 56. More specifically, the mounting flange 56 includes boss portions $\mathbf{56}_1$, $\mathbf{56}_2$ and $\mathbf{56}_3$ at its opposite ends, respectively. The two upper opposed boss portions $\mathbf{56}_3$, $\mathbf{56}_3$ are connected to each other by a bar-shaped connecting portion 114, and two lower opposed boss portions $\mathbf{56}_1$, $\mathbf{56}_1$ are connected to each other by a bar-shaped connecting portion 115. Therefore, the mounting flange 56 for two exhaust pipes 19 is coupled to the cylinder head 12 by a total of six bolts 57.

Particularly, the two opposed boss portions $\mathbf{56}_3$, $\mathbf{56}_3$ of the mounting flange 56 for the exhaust pipes 19 are fastened by the bolts 57 to the reinforcing walls 61 which connect the spark plug insertion tubes 21 with the upper surfaces of the first and second protrusions 49*a* and 49*b*. Therefore, the rigidity of support of the exhaust pipes 19 can be remarkably increased to alleviate the vibration.

Two exhaust emission control catalysts 41 mounted at lower portions of the two exhaust pipes 19, respectively, are integrally coupled to each other by a connecting flange 116 which is mounted at lower ends of the exhaust emission control catalysts 41 to couple further downstream exhaust pipes (not shown) integrally coupled each other at opposed portions of the exhaust emission control catalysts 41.

By mounting the exhaust emission control catalysts 41, 41 directly at the lower end of the exhaust pipes 19 fastened at their upper end to the cylinder head 12, the distance from the combustion chambers 16 to the exhaust emission control catalysts 41 can be shortened to prevent the drop of the temperature of an exhaust gas, and the exhaust emission control catalysts 41 can be promptly activated by the heat of the exhaust gas to enhance the exhaust emission control performance.

In addition, because the exhaust emission control catalysts 41 having a large weight are mounted in the exhaust pipes 19, the two exhaust pipes 19 are liable to be vibrated along with the exhaust emission control catalysts 41. However, both of the exhaust pipes 19 are integrally connected to each other at their lower portions by the exhaust emission control catalysts 41 and at their upper portions by the mounting flange 56 and hence, the exhaust pipes 19 the exhaust emission control catalysts 41 and the mounting flange 56 reinforce one another, whereby the vibration can be alleviated. Moreover, the mounting flange 56 is fastened at its opposite ends to the exhaust outlets 48 of the first and second collecting exhaust ports 18*a* and 18*b* to have a span long enough in the direction of the cylinder array line $L_2$ and hence, the rigidity of supporting of the exhaust pipes 19 is increased, and the vibration alleviating effect is further enhanced. As a result, reinforcing members such as stays for supporting the exhaust pipes 19 and the exhaust emission control catalysts 41 are not required for alleviating the vibration, which can contribute to a reduction in number of parts and the compactness of the engine E.

Although the embodiments of the present invention have been described in detail, it will be understood that the present invention is not limited to the above-described embodiments, and various modifications in design may be made without departing from the spirit and scope of the invention defined in claims.

For example, the in-line type 3-cylinder engine E and the in-line type 6-cylinder engine E have been illustrated in the embodiments, but the present invention is also applicable to banks of other in-line type engines having a different number of cylinders and V-type engines.

In addition, the oil return passages $\mathbf{55}_1$ to $\mathbf{55}_6$ have been illustrated as the oil passages in the embodiments, but the oil passages used in the present invention include an oil supply passage for supplying an oil from the cylinder block 11 to the valve operating chamber 23 within the cylinder head 12, and a blow-by gas passage which permits the valve operating chamber 23 within the cylinder head 12 to communicate with the crankcase to perform the ventilation of a blow-by gas.

The exhaust emission control catalyst 41 has a circular cross section in the embodiments, but the cross section of the exhaust emission control catalyst 41 need not be necessarily circular. If the cross section of the exhaust emission control catalyst 41 is of an elliptic shape having a longer axis in the direction toward the cylinder axis $L_1$, or of such a non-circular shape that it is bulged in the direction toward the cylinder axis $L_1$, the dead space below the protrusion 49 can be effectively utilized.

In addition, the structure of the vibration absorbing means D is not limited to that in each of the embodiments, and other various structures can be employed.

Further, the pluralities of protrusions, exhaust collecting sections and collecting exhaust ports are provided, and the number of each of them is not necessarily limited to two and may be three or more. In this case, the number of the connecting walls 102 and 103 is not necessarily limited to two and may be one or three or more. Yet further, the water jackets $J_2$ and $J_3$ may be defined in only either one of the upper and lower surfaces of the first and second exhaust collecting sections 47*a* and 47*b*, in place of being defined in both of the upper and lower surfaces.

What is claimed is:

1. A multi-cylinder engine comprising a collecting exhaust port which includes a plurality of exhaust port sections extending from a plurality of combustion chambers arranged along a cylinder array, said plurality of exhaust port sections being integrally collected together into an exhaust collecting section defined within a cylinder head, wherein an oxygen concentration sensor for detecting a concentration of oxygen in an exhaust gas is mounted on said cylinder head so as to have a detecting portion thereof disposed to face the exhaust collecting section.

2. A multi-cylinder engine comprising a collecting exhaust port which includes a plurality of exhaust port sections extending from a plurality of combustion chambers arranged along a cylinder array, said plurality of exhaust port sections being integrally collected together into an exhaust collecting section defined within a cylinder head, wherein a protrusion is formed to project outwardly in an arch shape from a side surface of the cylinder head, and an oxygen concentration sensor for detecting a concentration of oxygen in an exhaust gas is mounted so as to have a detecting portion thereof disposed to face the exhaust collecting section and a body portion thereof opposed to a side wall of said protrusion.

3. A multi-cylinder engine according to claim 2, wherein said oxygen concentration sensor is mounted in the vicinity of an exhaust outlet defined at an outer end of the protrusion of the cylinder head, said body portion of the oxygen concentration sensor being fixed in the vicinity of the exhaust outlet disposed parallel to the cylinder array, said detecting portion being provided at a tip end of the body portion, and the oxygen concentration sensor further includes a harness extending from a rear end of the body portion.

4. A multi-cylinder engine according to claim 3, wherein dead spaces are defined on opposite sides of the protrusion in the direction of the cylinder array and the oxygen concentration sensor is disposed in one of the dead spaces such that the body portion is gradually spaced apart from the side wall of the protrusion.

5. A multi-cylinder engine according to claim 2, wherein a chamber is provided for accommodating a driving device for a cam of the engine, and the oxygen concentration sensor is disposed on an opposite side from said chamber.

6. A multi-cylinder engine comprising a collecting exhaust port which includes a plurality of exhaust port sections extending from a plurality of combustion chambers arranged alone a cylinder array, said plurality of exhaust port sections being Integrally collected together into an exhaust collecting section defined within a cylinder head, wherein an oxygen concentration sensor for detecting a concentration of oxygen in an exhaust gas is mounted so as to have a detecting portion thereof disposed to face the exhaust collecting section, wherein a chamber is provided for accommodating a driving device for a cam of the engine, and the oxygen concentration sensor is disposed on an opposite side from said chamber.

7. A multi-cylinder engine according to claim 6, wherein a protrusion is formed to project outwardly in an arch shape from a side surface of the cylinder head.

8. A multi-cylinder engine according to claim 6, wherein said oxygen concentration sensor is mounted in the vicinity of an exhaust outlet defined at an outer end of the protrusion of the cylinder head, a body portion of the oxygen concentration sensor is fixed in the vicinity of the exhaust outlet disposed parallel to the cylinder array, and said detecting portion being provided at a tip end of the body portion.

9. A multi-cylinder engine according to claim 8, wherein the oxygen concentration sensor further includes a harness extending from a rear end of the body portion.

10. A multi-cylinder engine according to claim 8, wherein dead spaces are defined on opposite sides of the protrusion in the direction of the cylinder array and the oxygen concentration sensor is disposed in one of the dead spaces such that the body portion is gradually spaced apart from the side wall of the protrusion.

* * * * *